US005719363A

United States Patent [19]

Händler

[11] Patent Number: 5,719,363

[45] Date of Patent: Feb. 17, 1998

[54] MECHANICAL SWITCHING DEVICE SUCH AS A CIRCUIT BREAKER AND A SAFETY DEVICE FOR THE CIRCUIT BREAKER

[75] Inventor: Kurt Händler, Bonn, Germany

[73] Assignee: Klöckner-Moeller GmbH, Bonn, Germany

[21] Appl. No.: 628,258

[22] Filed: Apr. 5, 1996

[30] Foreign Application Priority Data

Apr. 8, 1995 [DE] Germany ..... 29506151 U

[51] Int. Cl.[6] ..... H01H 71/16; H01H 73/12; H01H 75/00; H01H 9/00

[52] U.S. Cl. ..... 200/50.02; 335/172; 335/174; 335/173; 335/17

[58] Field of Search ..... 200/340, 50.02, 200/42 R, 50 A, 50 R, 153 G; 335/167, 42, 171, 13, 172, 176, 17–26

[56] References Cited

U.S. PATENT DOCUMENTS

| | | | |
|---|---|---|---|
| Re. 34,396 | 10/1993 | Wollenhaupt | 200/50 R |
| 3,590,180 | 6/1971 | Puetz | 200/50 A |
| 4,152,683 | 5/1979 | Rys | 335/17 |
| 4,622,530 | 11/1986 | Ciarcia et al. | 335/167 |
| 4,701,733 | 10/1987 | Osmond | 335/18 |
| 4,724,411 | 2/1988 | Matsumoto et al. | 335/172 |
| 5,369,384 | 11/1994 | Heins . | |
| 5,508,670 | 4/1996 | Mantzouridis et al. . | |

FOREIGN PATENT DOCUMENTS

| | | |
|---|---|---|
| 0035083 | 9/1981 | European Pat. Off. . |
| 0049209 | 4/1982 | European Pat. Off. . |
| 0549083 | 6/1993 | European Pat. Off. . |
| 0567415 | 10/1993 | European Pat. Off. . |
| 3008249 | 9/1981 | Germany . |
| 3037355 | 4/1982 | Germany . |
| 4227213 | 2/1994 | Germany . |

*Primary Examiner*—Peter S. Wong
*Assistant Examiner*—Rajnikant B. Patel
*Attorney, Agent, or Firm*—Nils H. Ljungman and Associates

[57] ABSTRACT

A safety device for mechanical switching devices such as circuit breakers which can be mounted on mounting surfaces or plugged into plug-in pin bases. The safety device ensures that the mechanical switching device is tripped both when it is being installed, and also when it is being removed.

20 Claims, 19 Drawing Sheets

D

E

F

MECHANICAL SWITCHING DEVICE SUCH AS A CIRCUIT BREAKER AND A SAFETY DEVICE FOR THE CIRCUIT BREAKER

BACKGROUND OF THE INVENTION

1. Field of the Invention

The present invention generally relates to a safety device for a mechanical switching device, which switching device can be mounted on a mounting surface such as a plug-in pin base, mounting plate or mounting rail. The switching device has movable contacts with a correspondingly designed connection surface, and an actuator mechanism with a rocker arm, switch lock and latching mechanism for the movable contacts of the mechanical switching device. The switching device can also contain a safety plunger which is located in the mechanical switching device so that the safety plunger can be displaced against the force of a spring. The safety plunger is linked by means of one terminal area with the latching mechanism of the switch lock, and the other terminal area of the safety plunger can be extended out of the mechanical switching device, and can effect a tripping of the mechanical switching device when the mechanical switching device is raised off of, or lowered onto, the mounting surface.

2. Background Information

Mechanical switching devices such as low voltage switching devices, power circuit breakers and load interrupters are typically equipped with an actuator mechanism which has switch locks, whereby reference is made to German Patent No. 42 27 213 A1, which corresponds to U.S. Pat. No. 5,369,384, for example, which patents describe a switch lock for such a mechanical switching device which opens reliably. The text of this German Patent No. 42 27 213, and the text of U.S. Pat. No. 5,369,384, are incorporated herein by reference, with particular regard to the basic construction of such mechanical switching devices.

Mechanical switching devices, e.g. power circuit breakers, are typically installed on mounting surfaces such as mounting plates, mounting rails or even plug-in pin bases. This type of installation of a mechanical switching device, in which the power circuit breaker is equipped with a plug-in pin base, for the rapid replacement of the power circuit breaker following a short circuit, is generally known.

During the replacement of a mechanical switching device such as a power circuit breaker, i.e. during its removal from the mounting base, plate or rail and the installation of a new mechanical switching device, it must be possible to guarantee that the mechanical switching device may not be closed.

European Patent No. 0 567 415 , A1, which corresponds to U.S. Pat. No. 5,334,808, discloses a mechanical switching device which can be installed on a plug-in pin base and is equipped with a device for pre-tripping. This device trips the removable mechanical switching device when the mechanical switching device is plugged in or removed from the plug-in pin base. For this purpose, as disclosed in European Patent No. 0 567 415 A1 and U.S. Pat. No. 5,334,808, there is a rigid cam on the bottom of the mounting surface, i.e. on the bottom of the plug-in pin base, which cam interacts with a wiper and a transmission lever so that the transmission lever is actuated during the installation or removal process, and the removable mechanical switching device, e.g. the power circuit breaker, is thereby tripped.

This particular safety device disclosed in European Patent No. 0 567 415 A1 and U.S. Pat. No. 5,334,808 is complex and expensive, and can only be used in connection with a plug-in pin base, since there must be a control cam on the mounting surface, which cam, by means of a wiper and a transmission lever, generates a control movement which then acts on the switch lock.

German Patent No. 30 08 249 A1 and German Patent No. 30 37 355 A1 disclose a safety device for circuit breakers in which, in addition to the tripping elements which respond to the current, there is a tripping pin which is guided so that it can be displaced in the housing of the mechanical switching device against the force of a spring. The purpose of this tripping pin is to force a tripping of the circuit breaker if it is removed from its mounting surface. One important area of application of such tripping pins is plug-in circuit breakers.

OBJECT OF THE INVENTION

One object of the present invention is to improve known safety devices for mechanical switching devices of the type described above, which mechanical switching devices are mounted on or plugged into a mounting surface, such that the mechanical switching device is tripped both when it is installed and when it is removed. An additional object of the present invention is to make it possible to use the same safety device for mechanical switching devices of different sizes, and thereby make it possible to manufacture the device economically.

SUMMARY OF THE INVENTION

The present invention teaches that it is possible to accomplish this object on a safety device for mechanical switching devices having a switch lock in that the terminal area of the plunger, which plunger is linked to the latching mechanism, has an operating cam with at least one oblong control cam. The at least one control cam can be bevelled on both sides, and, if more than one control cam is desired, the control cams can preferably be arranged one after another in the longitudinal direction of the safety plunger.

In accordance with the present invention, the configuration of the operating cam with one or more control cams which are bevelled on both sides can make it possible to trip the mechanical switching device both when it is being installed, and when it is being removed from a mounting surface or a plug-in pin base. As a result of the presence of a plurality of control cams, in accordance with one embodiment of the present invention, it can be possible to use the safety plunger for mechanical switching devices of different sizes and depths.

The safety device operates with only a few parts, i.e. basically with one additional movable part, namely a safety plunger which is installed in the mechanical switching device. Essentially, no additional constructive measures on the mounting surface, namely on the plug-in pin base or the mounting plate or mounting rail, are necessary as a result of the use of the safety device in accordance with the present invention. Therefore the safety device can be used essentially universally. As a result of the design of the invention, which uses only one additional part, namely the safety plunger, not only can the safety device be manufactured more efficiently and economically, but the problem of maintaining tolerances can be reduced by the use of only a few parts.

The safety device of the present invention functions as follows: When the mechanical switching device, e.g. a power circuit breaker, is installed in a plug-in pin base or on a mounting plate, the safety plunger is pushed up by the plug-in pin base or the mounting plate when the plunger comes into contact with the base or the mounting plate, i.e. the plunger is pushed into the mechanical switching device. As a result of the movement of the safety plunger, the latching mechanism with which the safety plunger is connected is moved and trips, i.e. the tripped position of the mechanical switching device is established during the installation from the moment when the safety plunger is placed in motion as a result of its contact with the mounting surface. Conversely, during the removal of the power circuit breaker, the removal of the mechanical switching device from the mounting surface sets the safety plunger in motion, although of course this time the safety plunger moves in the direction out of the mechanical switching device, and as a result of the linkage with the latch, a movement is also transmitted to the latching mechanism, which results in the tripping of the mechanical switching device.

In accordance with one advantageous feature of the present invention, the safety plunger is under the action of a spring force, such that when the mechanical switching device is removed from the mounting plate or plug-in pin base, the extendable terminal area of the safety plunger, under the action of the spring force, is in a position in which the terminal area has moved out beyond the connecting surface of the mechanical switching device, and when the mechanical switching device is installed, the extendable terminal area of the safety plunger, because it is supported on the mounting plate, is in a position where it can be retracted or pushed back into the mechanical switching device against the force of the spring.

In accordance with an additional configuration of the present invention, the terminal area of the safety plunger which is linked to the latching mechanism is provided with an operating cam in the form of one or more oblong control cams. The control cam or cams can preferably be bevelled on both sides, and, if more than one control cam is desired, the control cams can be located one after another in the longitudinal direction of the safety plunger. It is thereby also possible to use the safety plunger for mechanical switching devices of different sizes and capacities, in particular for mechanical switching devices which have different depths of insertion. Each of the control cams is provided for linkage with the latching mechanism of mechanical switching devices of a specified size.

The present invention teaches that the linkage between the safety plunger and the latching mechanism can be used to bring about the tripped status by means of the latch and lever of the latching mechanism, whereby the lever is mounted so that it can rotate around a fulcrum. During the movement of the safety plunger, in accordance with one embodiment, the lever can slide along the operating cam itself, namely through a latching depression formed by the bevelling of the control cam, over the control cam and into the next latching depression, as a result of which a rotational movement of the lever around its fulcrum is produced, which results in the tripping of the latching mechanism and thus of the switch lock of the mechanical switching device.

In particular, the safety plunger is equipped with an operating cam so that the tripped position can be reached when the linkage between the latch and one or more control cams is established during the movement of the safety plunger, and, in accordance with one embodiment, the untripped position of the mechanical switching device can be established when there is a linkage between the latch and the latching depression. In other words, in each respective limit position of the safety plunger, namely when the mechanical switching device has been completely mounted or installed, or when the mechanical switching device has been completely removed, the linkage between the latching mechanism and the safety plunger is in a limit position, and namely in a latching depression of the operating cam which has no effect on the latching mechanism. In accordance with this embodiment, only when a linkage has been established between the latching mechanism and the control cam or cams of the safety plunger is an unlatching and a tripped status of the mechanical switching device established by a movement of the latching mechanism, namely by a movement of the latch, and only in this position is the tripped status maintained.

In accordance with an additional configuration of the present invention, the connection side of the mechanical switching device can be provided with a recess. In accordance with at least one embodiment, the terminal area of the safety plunger can be provided with a compression spring. This recess can preferably have at least one step to locate or receive the terminal area of the safety plunger with the compression spring, in which the terminal area of the safety plunger and the compression spring are placed when the mechanical switching device is installed, so that, for example, when the mechanical switching device is set up and installed on a mounting plate, the mounting plate can be realized so that it is flat, and when the mechanical switching device has been installed, the safety plunger is flush with the connection surface of the mechanical switching device and the mounting surface.

In the cases in which the mechanical switching device is plugged into a plug-in pin base, it is also possible to have the safety plunger project beyond the connection surface, even when the mechanical switching device has been installed, if the plug-in pin base has a corresponding locator depression, i.e. the mounting surface which forms the abutment for the safety plunger is lower than the joint between the mechanical switching device and the plug-in pin base socket.

The longitudinal axis of the safety plunger is preferably axially parallel to the direction of installation and removal of the mechanical switching device, and to the direction of movement of the safety plunger.

For a simple configuration of the safety plunger and to hold the compression spring securely, it is advantageous to realize the terminal area of the safety plunger which can be extended beyond the connection area of the mechanical switching device in the form of a head end, i.e. the end of the safety plunger is enlarged to form a head, so that this head can simultaneously be used as a flange and as a contact surface for the compression spring.

In accordance with one embodiment of the present invention, instead of a compression spring, a leaf spring may be utilized for biasing the safety plunger.

To prevent, in a simple manner, the safety plunger from falling out of the mechanical switching device, the present invention teaches that one embodiment of the safety plunger can be realized so that it has a projecting stop or a similar device in the area between its two ends. This stop can interact with a corresponding abutment on the mechanical switching device. As a result, the movement of the safety plunger or device out of the switching device is limited, whereby the movement of the safety plunger into the mechanical switching device is restricted by the head-like end and also by the compression spring, if one is present. If the stop is realized in the form of a latching hook, the safety plunger can be easily retrofitted with such a stop.

When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to several embodiments which are illustrated in the accompanying drawings, in which.

DESCRIPTION OF THE PREFERRED EMBODIMENT

Figure 1:
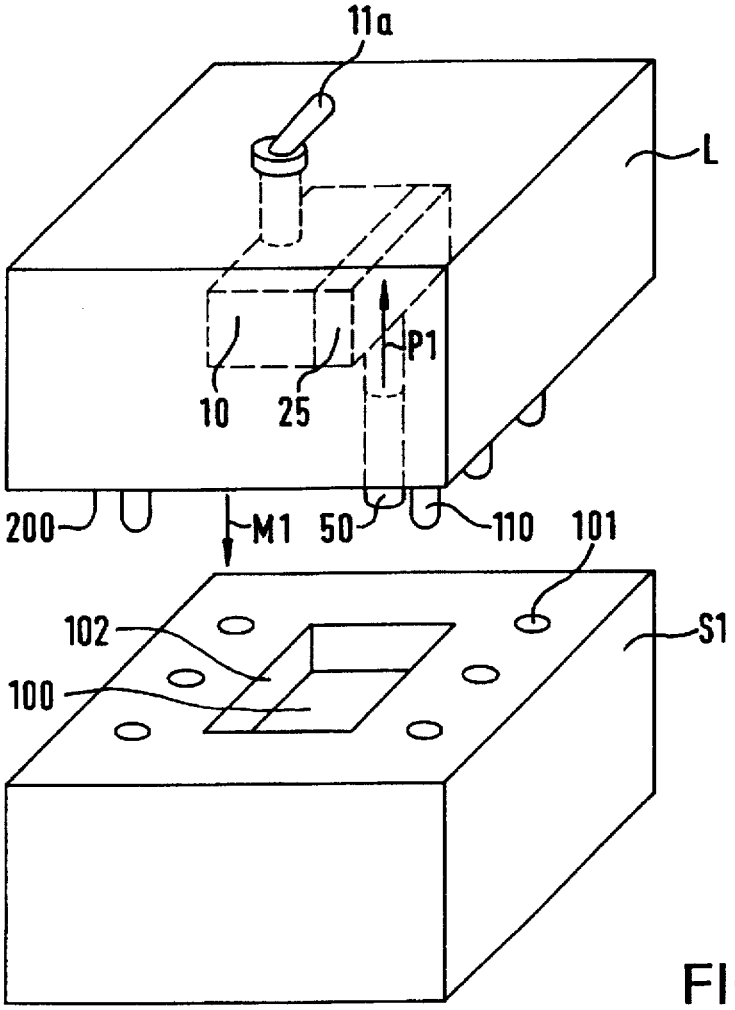
FIG. 1 schematic illustration of a mechanical switching device with a plug-in pin base, with the mechanical switching device removed.
Figure 3:
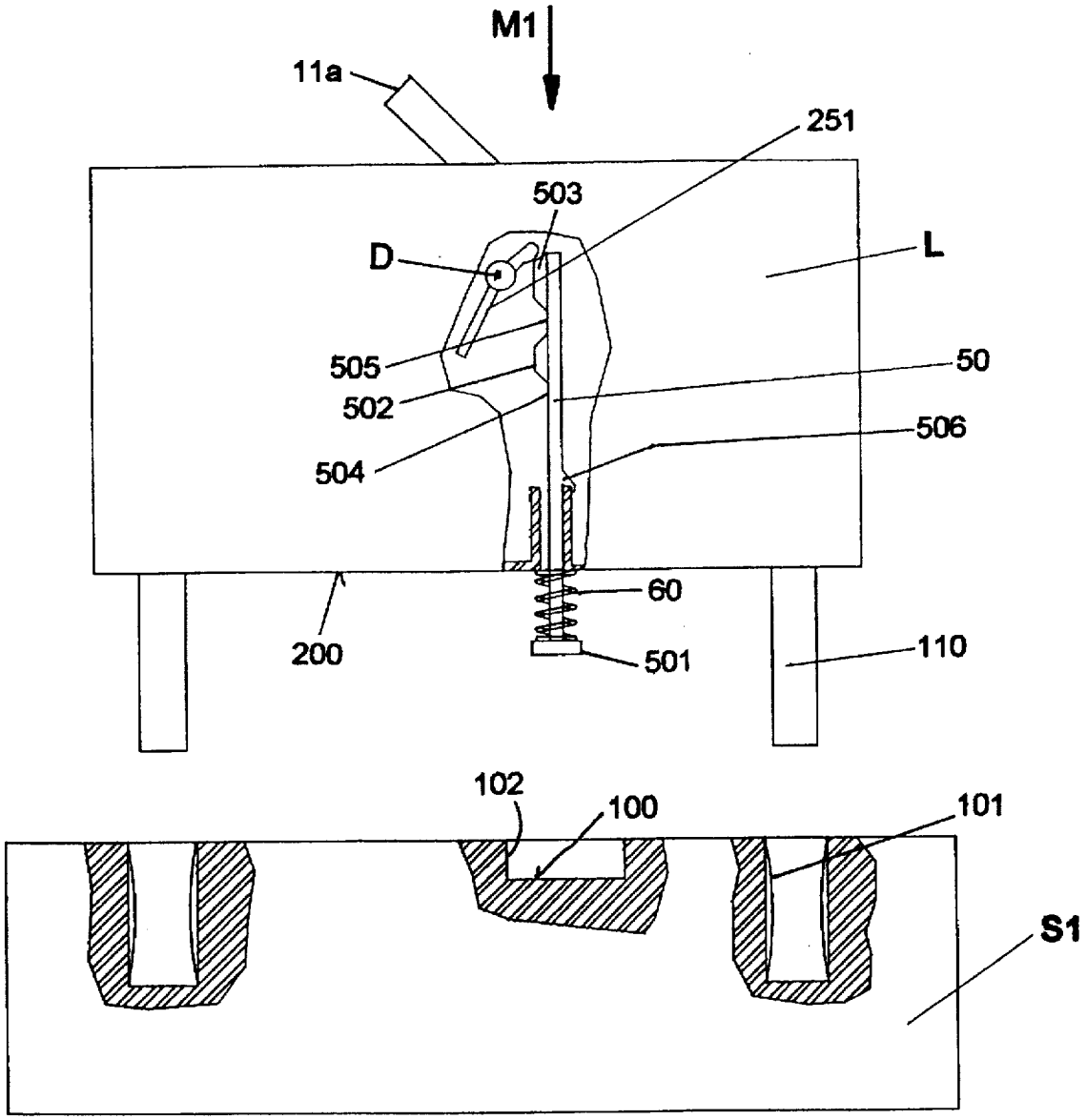
FIG. 3 is a schematic illustration of a mechanical switching device with a plug-in pin base, not yet installed, in a side view.

FIG. 1 is a schematic illustration of a mechanical switching device with a power circuit breaker L which is designed to be mounted on a plug-in pin base S1. FIG. 3 shows such a mechanical switching device L in a schematic side view. The power circuit breaker L can preferably be realized with a plug-in device in the form of plug-in pins 110, e.g. in two parallel rows of three pins each on opposite sides of the mechanical switching device L, which plug-in pins 110 can be realized so that they can engage with corresponding locator contacts 101 on the upper side, i.e. of the mounting surface of the plug-in pin base S1. The plug-in pins or contacts 110 of the power circuit breaker L project beyond a connection surface 200 of the mechanical switching device L.

The power circuit breaker L can include an actuator mechanism with a rocker arm 11*a* and a schematically illustrated switch lock 10. The switch lock 10 can have a latching mechanism 25 and latching lever 251 (see FIGS. 3 and 3A). The direction of installation of the circuit breaker L is designated M1. The line connections are located in the plug-in pin base S1. To essentially guarantee that in all cases, the switching device L is not closed during the replacement of a mechanical switching device L, i.e. both during installation in the direction indicated by the arrow M1 and also during removal, i.e. the extraction of the switching device L from the plug-in pin base S1, there is an additional safety device in the form of a safety plunger 50 in the mechanical switching device L. This safety plunger 50 can preferably move in the direction indicated by the arrow P1 when one end of plunger 50 comes into contact with a mounting surface 100 of the plug-in pin base S1. The mounting surface 100 can form part of a recess 102 of the plug-in pin base S1. The other end of the safety plunger 50 can be linked to the latching mechanism 25, i.e. to the latching lever 251 (see FIGS. 3 and 3A), which lever 251 can be moved as a result of the movement of the safety plunger 50 in the direction indicated by the arrow P1. The end of the safety plunger 50 which is linked to the latching mechanism 25 can be realized in the form of an operating cam with control cams 502, 503 which are bevelled on the sides, and latching depressions 505, 504 between them, as shown in FIGS. 3 and 3A.

Figure 3A:
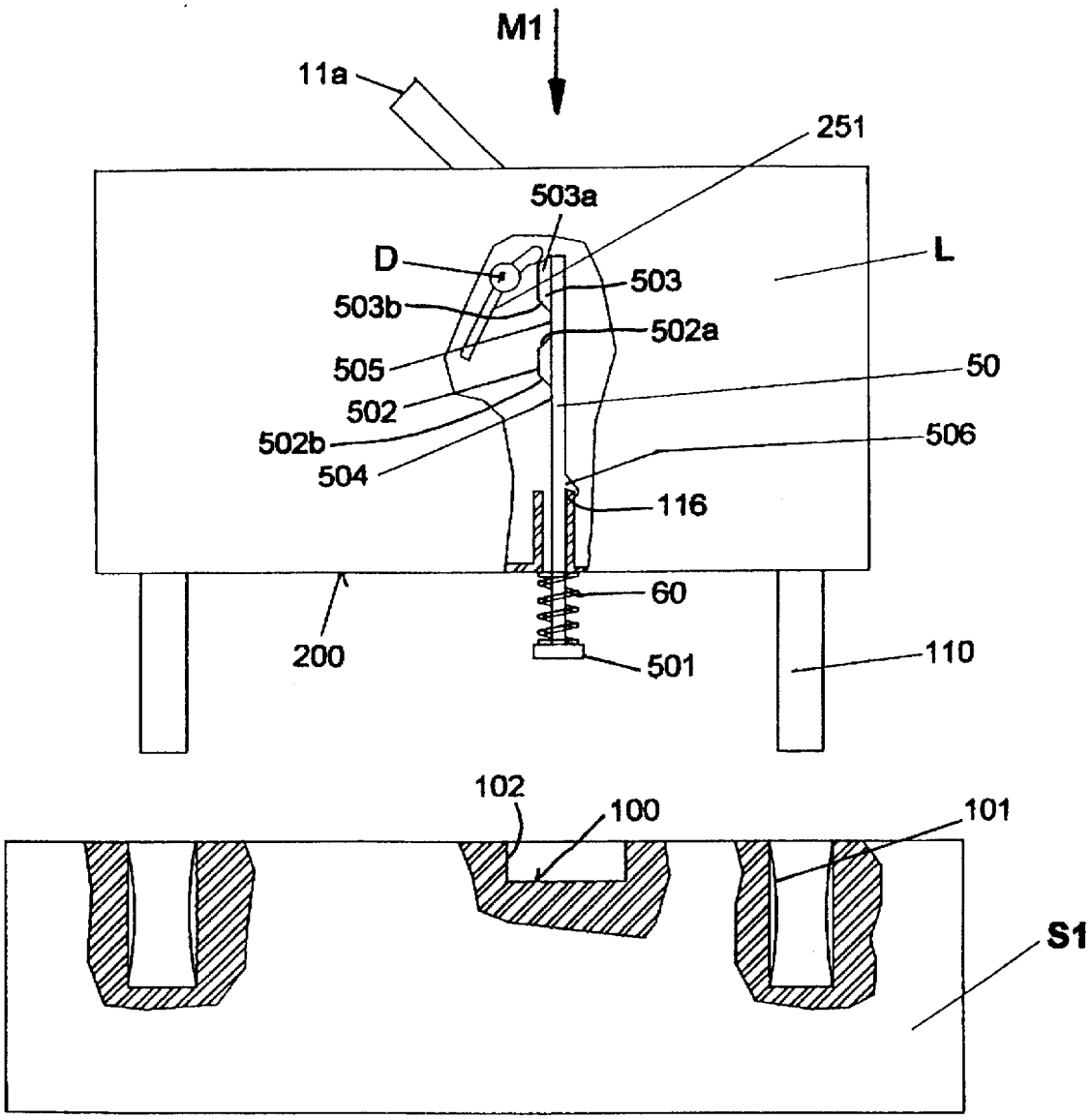
FIG. 3A is similar to FIG. 3, but is more detailed.

In accordance with one embodiment of the present invention as shown in FIG. 3A, control cam 503 can have bevelled surfaces 503*a* and 503*b* on both sides thereof, and control cam 502 can have bevelled surfaces 502*a* and 502*b* on both sides thereof. In addition, the safety plunger 50 can have a terminal area 501 in the form of an enlarged head. This terminal area 501 can preferably project beyond the connecting surface 200 of the switching device L.

Figure 2:
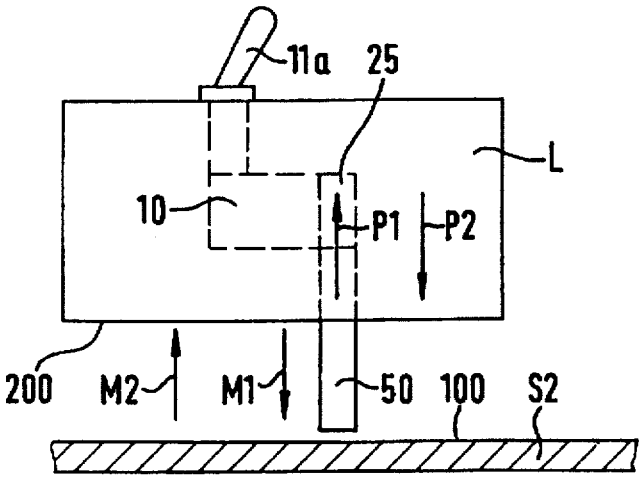
FIG. 2 is a schematic illustration of a mechanical switching device for installation on a mounting plate.

FIG. 2 is a schematic illustration of the installation of the mechanical switching device, e.g. of a power circuit breaker L, on a mounting plate S2 with a mounting surface 100. In this case, the mechanical switching device L does not have any plug-in pin contacts, but instead has a flat connecting surface 200. In the embodiment illustrated in FIG. 2, when the safety plunger 50 makes contact with the mounting area 100, the safety plunger 50 with its terminal area 501, which terminal area 501 projects beyond the connecting surface 200 of the mechanical switching device L, is moved in the direction indicated by the arrow P1, namely during mounting of the switching device L in the installation direction M1, and, thus the safety plunger 50 is moved into the mechanical switching device L, and the action and tripping described above with reference to FIG. 1 occurs. Conversely, during the removal of the mechanical switching device L from the mounting plate S2 in the direction indicated by the arrow M2, the safety plunger 50 moves in the direction indicated by arrow P2 out of the mechanical switching device L beyond the connection surface 200, namely under the action of a compression spring 60 which is not shown here in any greater detail, but which spring 60 is discussed further below.

In mechanical switching devices which are equipped with the safety plunger 50 in accordance with the present invention, it can therefore be essentially guaranteed that during the installation of the mechanical switching device L in a plug-in pin base S1, or on a mounting plate S2 or on a mounting rail, the mechanical switching device L is not closed, and thus remains open until the mechanical switching device L has been completely installed or inserted into the plug-in pin base S1, the mounting plate S2, or mounting rail. This guarantee can also be provided for the removal process which takes place in the reverse order. In other words, the switching device L in all cases remains open, or is opened, during the extraction or removal of the mechanical switching device L from the plug-in pin base S1, mounting plate S2, or mounting rail.

Figure 4:
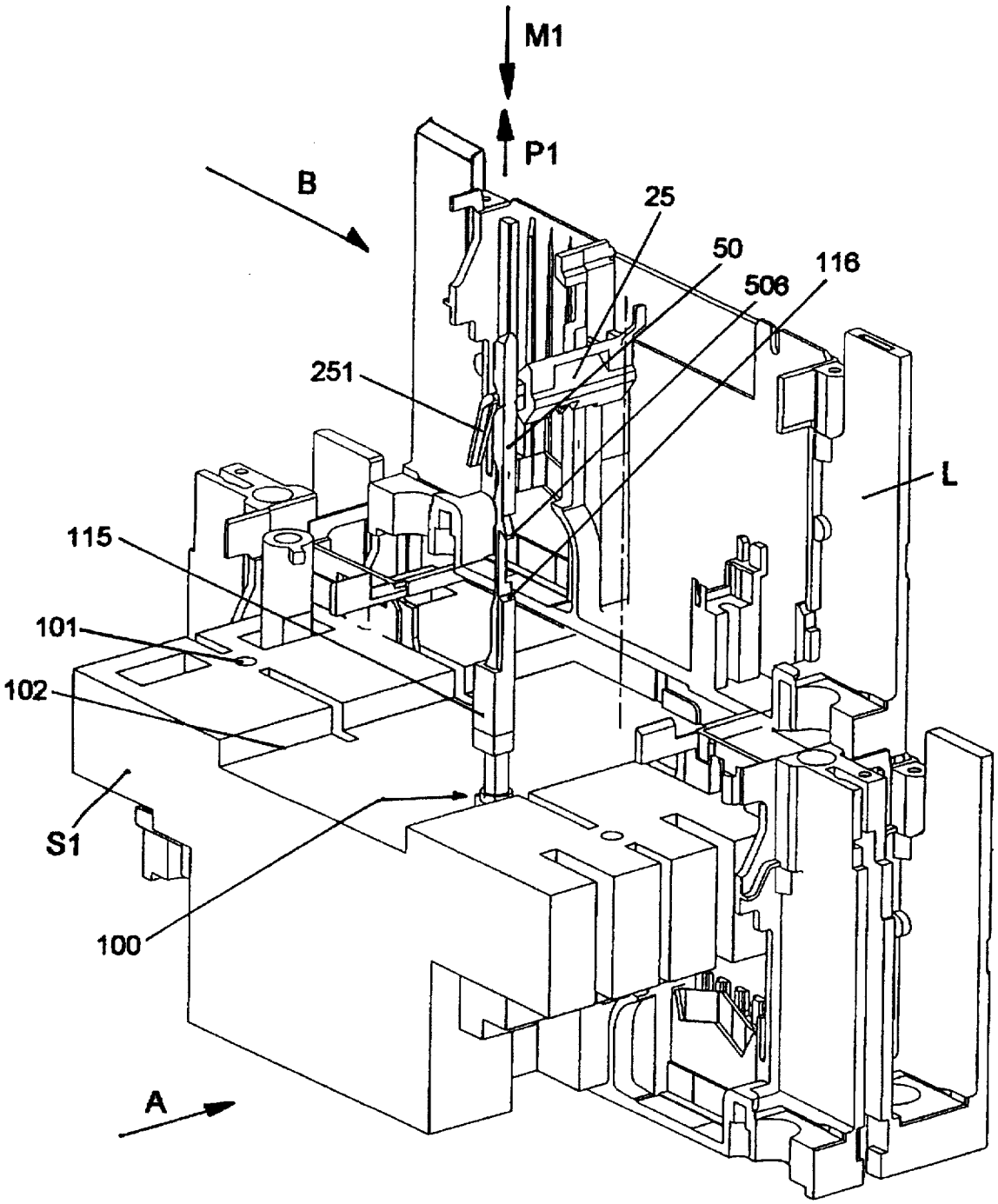
FIG. 4 is a partial view in perspective of a mechanical switching device as shown in FIG. 1, not yet installed.

FIG. 4 shows an illustration of one embodiment of a mechanical switching device L which is realized in the form of a plug-in mechanical switching device L with a plug-in pin base S1. The figure does not show the switch lock 10, e.g. like the one described in German Patent No. 42 27 213 A1 and U.S. Pat. No. 5,369,384, nor does it show the other parts which are not essential for the illustration and description of the operation of the safety plunger 50. However, the latching mechanism 25 is shown in FIG. 4 in relation to the lever 251. The illustration in FIG. 4 shows the situation during the installation of the mechanical switching device L in the plug-in pin base S1 at the moment when the safety plunger 50 has just been placed with its terminal area 501, which terminal area 501 projects beyond the connection surface 200 of the mechanical switching device L, above the mounting surface 100 of the plug-in pin base S1, i.e. the safety plunger 50 is still in a rest position, as illustrated schematically in FIG. 5 at position "a".

Figure 4A:
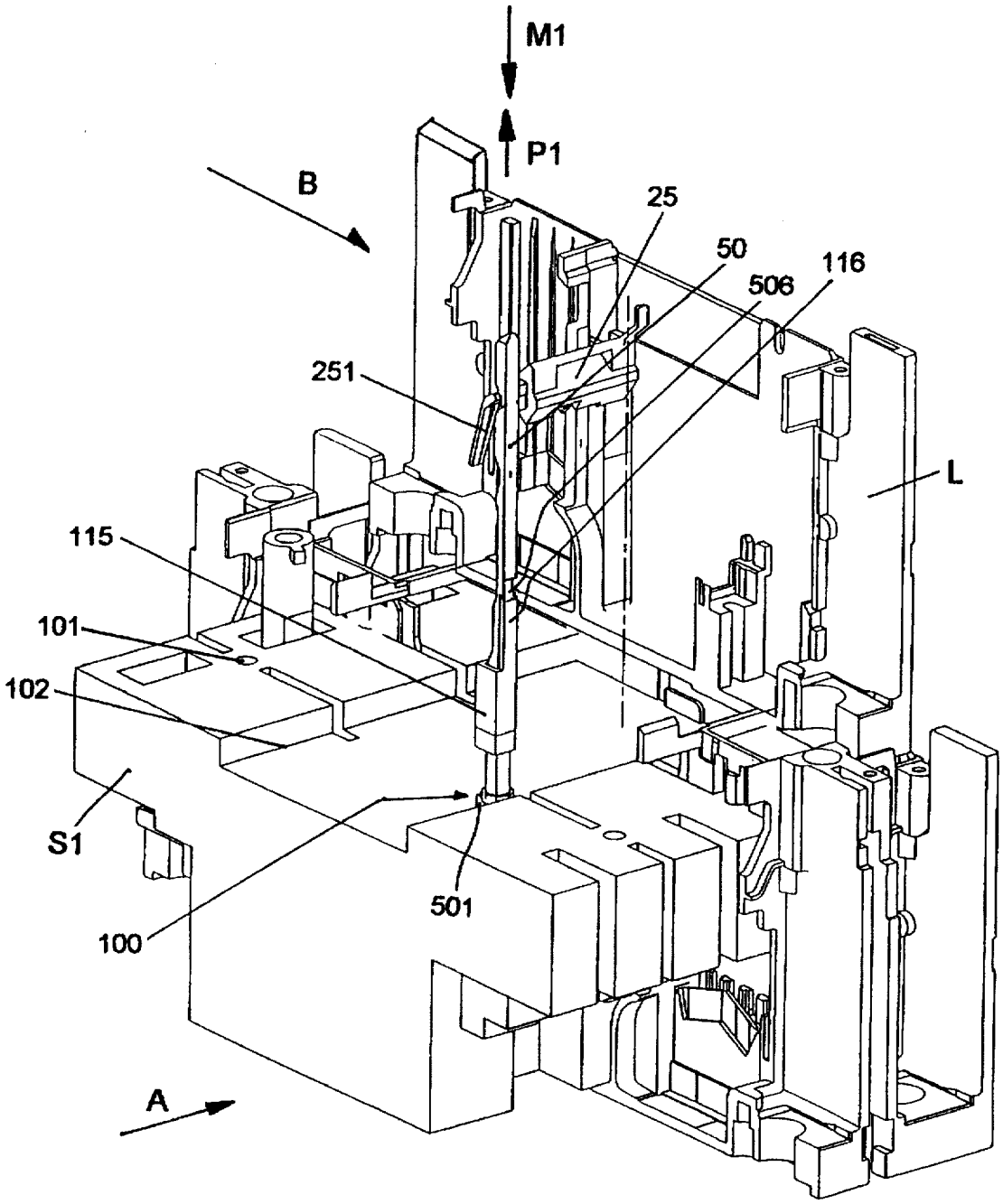
FIG. 4A is an embodiment similar to FIG. 4.
Figure 5:
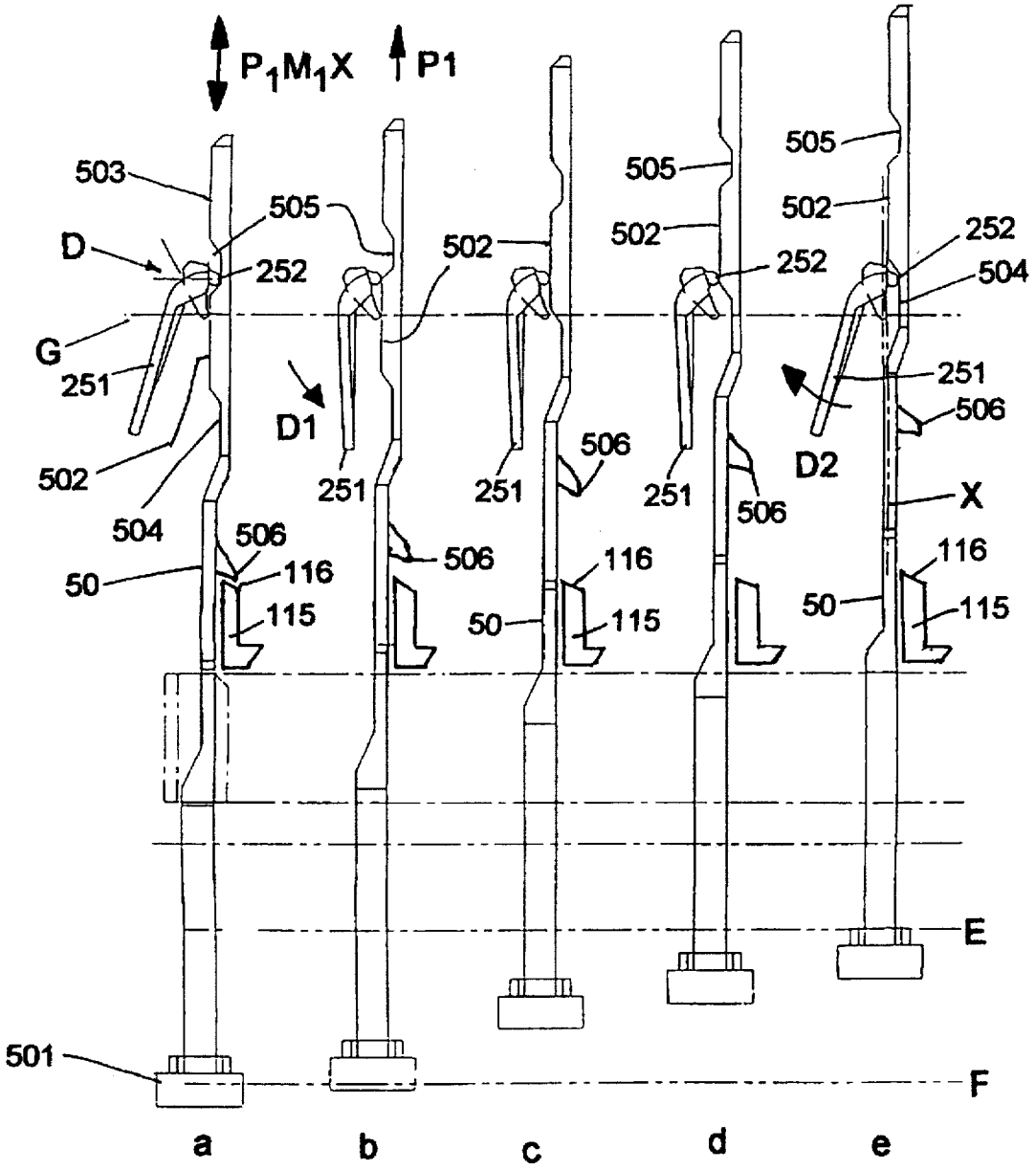
FIG. 5 shows the various positions (a–e) of the safety plunger illustrated in FIGS. 3, 3A, 4 and 4A during an installation process.

In other words, and in accordance with one embodiment shown in FIG. 4A, the position of the safety plunger 50 is similar to that shown in FIG. 5 at position "a", wherein the lever 251 is in contact with depression 505. In addition, in this position "a", the plunger 50 projects out of the switching device L, and has not yet been depressed into the switching device L. Further, the safety plunger 50 can be prevented from falling out of the switching device L by means of a stop 506 located on safety plunger 50, and a corresponding stop 116 of the housing 115 of the switching device L. FIG. 4A shows the stop 506 of the safety plunger 50 and the stop 116 of the housing 115 in contact with one another, as also shown in FIG. 5 at position "a".

As shown in FIGS. 4 and 4A, the plug-in pin base S1 has the recess 102 which forms the mounting surface 100, i.e. the abutment for the safety plunger 50. The socket S1 also has locator contacts 101 for the pin contacts 110 of the mechanical switching device L, which mechanical switching device L can be inserted in the mounting direction M1.

The function and construction of a switch lock 10 which has the latching mechanism and latch 25 is described by way of example in the above-referenced German Patent No. 42 27 213 and U.S. Pat. No. 5,369,384. The safety plunger 50 in the mechanical switching device L is provided to establish and essentially guarantee that the mechanical switching device L is tripped during the installation process, i.e. until the complete connection has been created between the mechanical switching device L and the mounting surface 100, i.e. of the socket S1 or the mounting plate S2. The safety plunger 50 is oriented so that when the mechanical switching device L is not installed, the safety plunger 50 projects with one terminal area 501 (see FIG. 4A) beyond the connection surface 200 of the mechanical switching device L, and is linked by means of its other end to the latching mechanism 25 of the switch lock 10 of the mechanical switching device L, in particular with the latch 25. The linkage with the latch 25 is preferably established by means of the latching lever 251 which can preferably be molded on one side of the latch 25.

In accordance with one embodiment of the present invention, the latching lever 251 can preferably be molded on one side of the latching mechanism or latch 25, so that the latch 25 and the lever 251 are one piece, or, alternatively, the latch 25 and lever 251 can simply be attached to one another such that the latch 25 and lever 251 can move together, in at least one direction as discussed further below. As discussed in further detail herebelow with regard to FIGS. 20 and 21, the latch 25 and the lever 251 can preferably be pivotable about a common axis. Thus, in accordance with one embodiment, any rotational or pivoting movement of the lever 251 can be transmitted to the latch 25 in at least one direction, if not two directions, as discussed further below.

The safety plunger 50, as illustrated schematically in FIG. 3 by way of example, can be moved in the direction indicated by the arrow P1, following contact between its head end 501 and the mounting surface 100, as the movement of the mechanical switching device L in the direction M1 continues. In this case, the safety plunger 50, by means of its other end which can be realized with an operating cam, is linked to the latching lever 251 of the latch 25 of the latching mechanism, so that in selected positions corresponding to the operating cam of the safety plunger 50, during movement of the safety plunger 50 in the direction indicated by the arrow P1, the latching lever 251 can be rotated around an axis which is at right angles to the longitudinal axis of the safety plunger 50. In other words, and in accordance with one embodiment, the latching lever 251 can be rotated around an axis, as discussed immediately hereinabove, which axis is at a right angle to the longitudinal axis of the plunger 50, and which axis would be perpendicular to the plane of the drawing in FIGS. 5 and 5A.

The linkage between the safety plunger 50 and the latching device, in particular the latching lever 251 of the latch 25, and the function of the safety plunger 50 during the installation and removal process, are illustrated in the schematic illustrations of the individual positions a–e of the safety plunger 50 during the movement of the safety plunger 50 shown in FIGS. 5 and 5A, which positions a–e are explained in greater detail below. The safety plunger 50, in its one terminal area which extends beyond the connection surface 200 of the mechanical switching device L, designated E as the base plane in FIGS. 5 and 5A, has the head-shaped part 501 on the end. The longitudinal axis X of the safety plunger 50 is axially parallel both to the direction of movement P1 of the plunger 50 and to the direction M1 in which the mechanical switching device L is being installed.

Opposite the terminal area of the safety plunger 50 which has the head 501, which terminal area can be moved out of or projects from the mechanical switching device L on the connection side, i.e. the base surface E, there can be an additional terminal area of the safety plunger 50 which is linked to the latching mechanism 25. This terminal area can be realized in the form of an operating cam which has control cams 503, 502, which control cams 503 and 502 can be bevelled on both sides. This terminal area can also have latching depressions 505, 504 which are realized in an alternating manner with cams 503 and 502, one after another, in the longitudinal direction of the safety plunger 50, and thereby form an extended, undulating operating cam which has raised portions and recessed portions. The latching lever 251 can rotate around a fulcrum D. In accordance with one embodiment, the fulcrum D of the lever 251 can preferably coincide with or lie on the rotational or pivoting axis of the latch 25 and lever 251, as discussed hereinabove.

The latching lever 251 is linked, i.e. it is in contact, with the safety plunger 50 by means of a projecting lug 252. Moreover, the safety plunger 50 has the stop 506 which is in contact with the corresponding abutment surface 116 of the housing 115 of the mechanical switching device L, which contact is illustrated by way of example in FIG. 5 at position "a" (also shown in FIG. 4A). This contact of stop 506 with surface 116 can thereby prevent the safety plunger 50 from being extended farther from the mechanical switching device L, or from falling out altogether. If the stop 506 is realized in the form of a latching hook, the safety plunger 50 can be easily retrofitted. The stop 506 can preferably be realized underneath the operating cam on the safety plunger 50.

Figure 5A:
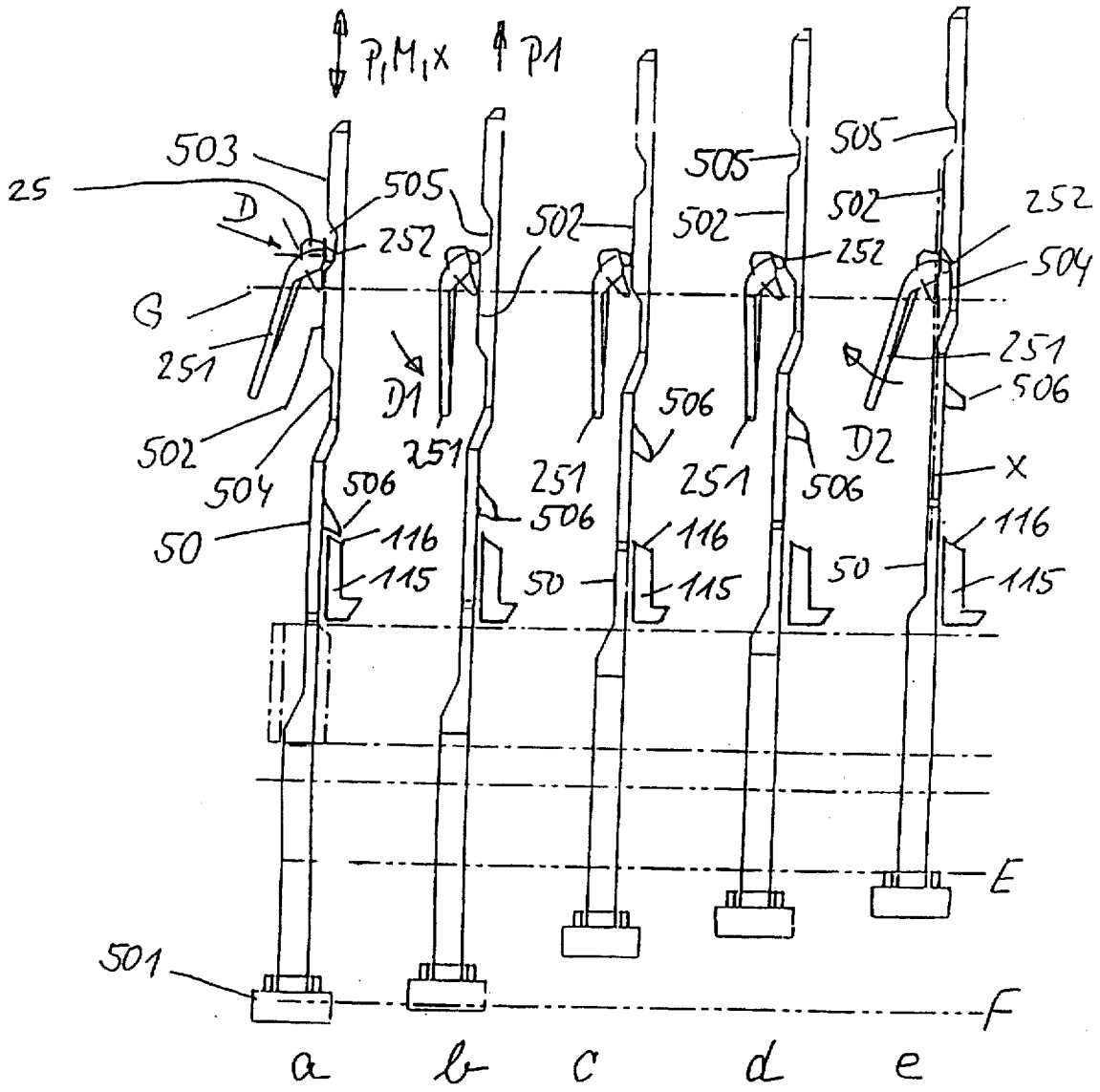
FIG. 5A is similar to FIG. 5, but is more detailed.

In the position of the mechanical switching device L illustrated in FIGS. 5 and 5A at position "a", when the mechanical switching device L has been removed from base S1 or plate S2, i.e. when the safety plunger 50 is in the position in which it is extended farthest from the mechanical switching device L, the latching lever 251 is in contact by means of its lug 252 in a latching depression 505 of the safety plunger 50. In this position "a", the safety plunger 50 essentially has no effect on the latching mechanism 25 or on the switch lock 10 of the mechanical switching device L.

In the position illustrated in FIGS. 5 and 5A at "b", the safety plunger 50, as a result of the installation movement of the switching device L in the direction M1 and the resulting movement of the safety plunger 50 in the direction indicated by arrow P1, has already moved into the mechanical switching device L by a short distance, i.e. it has been pushed in (by the abutment on the mounting surface 100, as illustrated in FIGS. 3, 3A, 4 and 4A). During this movement of the safety plunger 50 in the direction P1, the latching lever 251 has moved out of the latching depression 505 and is now on the control cam 502. In this case, the latching lever 251 has executed a rotational movement in the direction D1 around its fulcrum D, and has thereby driven the latch 25 to cause an unlatching of the latching mechanism of the switch lock 10. In other words, and in accordance with one embodiment, the switching device L has been "tripped".

As the safety plunger 50 continues to move in the direction indicated by the arrow P1, as illustrated in FIGS. 5 and 5A at positions "c" and "d", this unlatched position of the latching mechanism of the switch lock 10 can preferably be maintained while the latching lever 251 with its lug 252 slides along the control cam 502. In other words, and in accordance with one embodiment, the unlatched position of the switch lock 10 will be maintained as long as lug 252 of lever 251 is in contact with control cam 502. When the installed limit position is reached, as illustrated in FIGS. 5 and 5A at position "e", and the safety plunger 50 has arrived in its limit position, and the mechanical switching device L is inserted all the way into the plug-in pin base or socket S1, the latching lever 251 leaves the cam 502 of the operating cam and locks into the adjacent latching depression 504. In this limit position, in turn, the latching lever 251 moves in the direction indicated by the arrow D2 around its fulcrum D, and then has no further effect on the latching mechanism 25 of the switch lock 10.

In accordance with one embodiment, when the lever 251 moves in direction D2, the lever 251 can cause the latch 25 to also move in direction D2 and thus a "latched" position of the switch lock 10 can be restored. Alternatively, when the lever 251 moves in direction D2 upon reaching the depression 504, the lever 251 may also move the latch 25 in direction D2, but may not apply enough force to "relatch" the latch 25, and the breaker L may then have to be "cocked" by hand so as to completely reset the latch 25 and switch lock 10.

The process of removing the switching device L from the base S1 or plate S2 can preferably occur in the reverse direction of the positions of the safety plunger 50 illustrated in FIGS. 5 and 5A, namely from the position illustrated in FIGS. 5 and 5A at "e" backward into the position illustrated in FIGS. 5 and 5A at "a".

In accordance with one embodiment, the movement of the safety plunger 50 can preferably be produced under the action of a compression spring 60. The compression spring 60 is compressed during the installation of the mechanical switching device L, so that during the removal of the switching device L the spring 60 will necessarily push the safety plunger 50 out of the mechanical switching device L into a position which is limited, e.g. by the stop 506 against the abutment 116 on the housing 115.

Figure 6A:
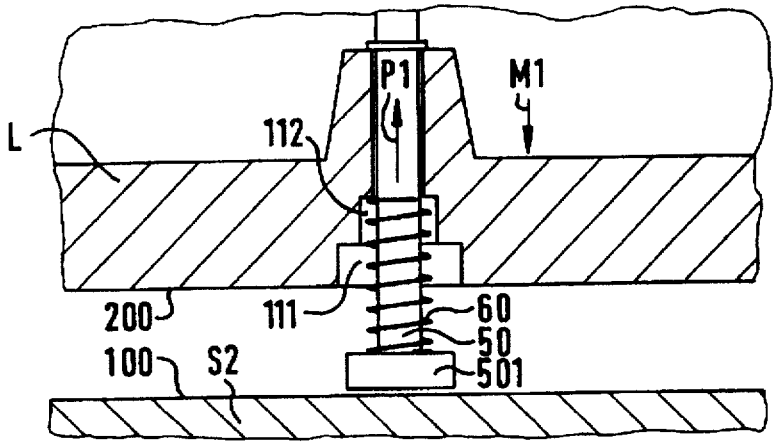
FIGS. 6A and 6B show details of the securing of the position of the safety plunger when it is in contact with a mounting plate.
Figure 6B:
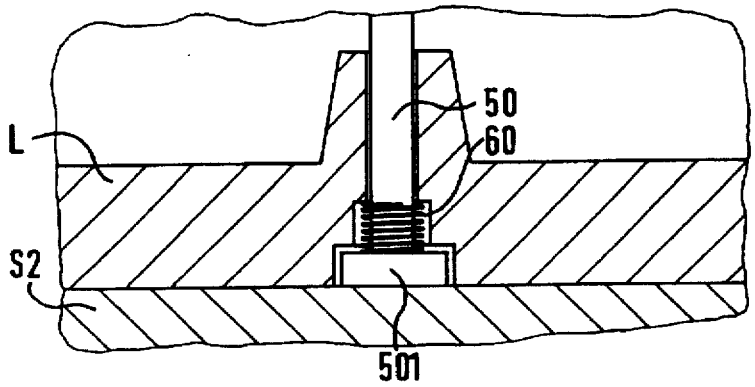

The function of the compression spring 60 is illustrated by way of example in FIGS. 6A and 6B. FIG. 6A shows the position of the safety plunger 50 extended out of the mechanical switching device L at the beginning of an installation process or movement M1, where the thicker head end 501 of the safety plunger 50 has just come into contact with the mounting surface 100 which forms the abutment, e.g. of a mounting plate S2. As the mechanical switching device L continues to move in the direction M1, the compression spring 60 is compressed and the safety plunger 50 is pushed back into the mechanical switching device L in the direction indicated by the arrow P1.

As shown in FIG. 6B, to achieve a flat contact between the contact surface 200 of the mechanical switching device L on the mounting surface 100 of the mounting plate S2, there can preferably be stepped recesses 111, 112 on the underside of the mechanical switching device L, into which recesses 111, 112 the compression spring 60 can fit when compressed, along with the thicker head end 501 of the safety plunger 50.

Figure 7:
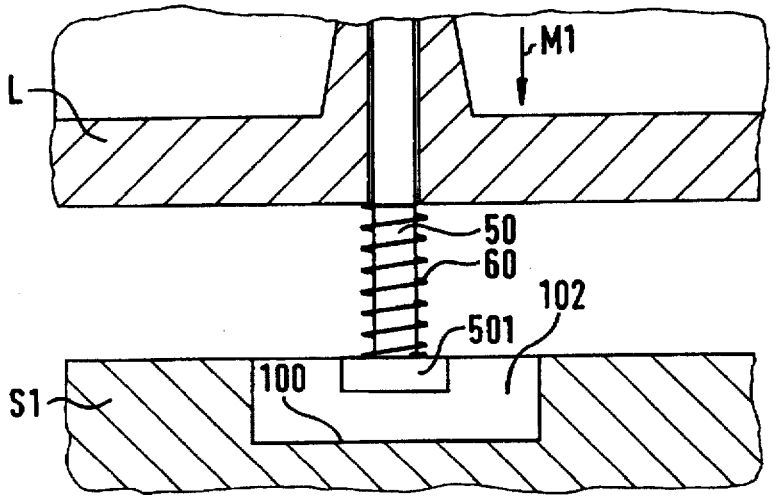
FIG. 7 is a detailed illustration of the position of the safety plunger for a plug-in pin base.
Figure 8:
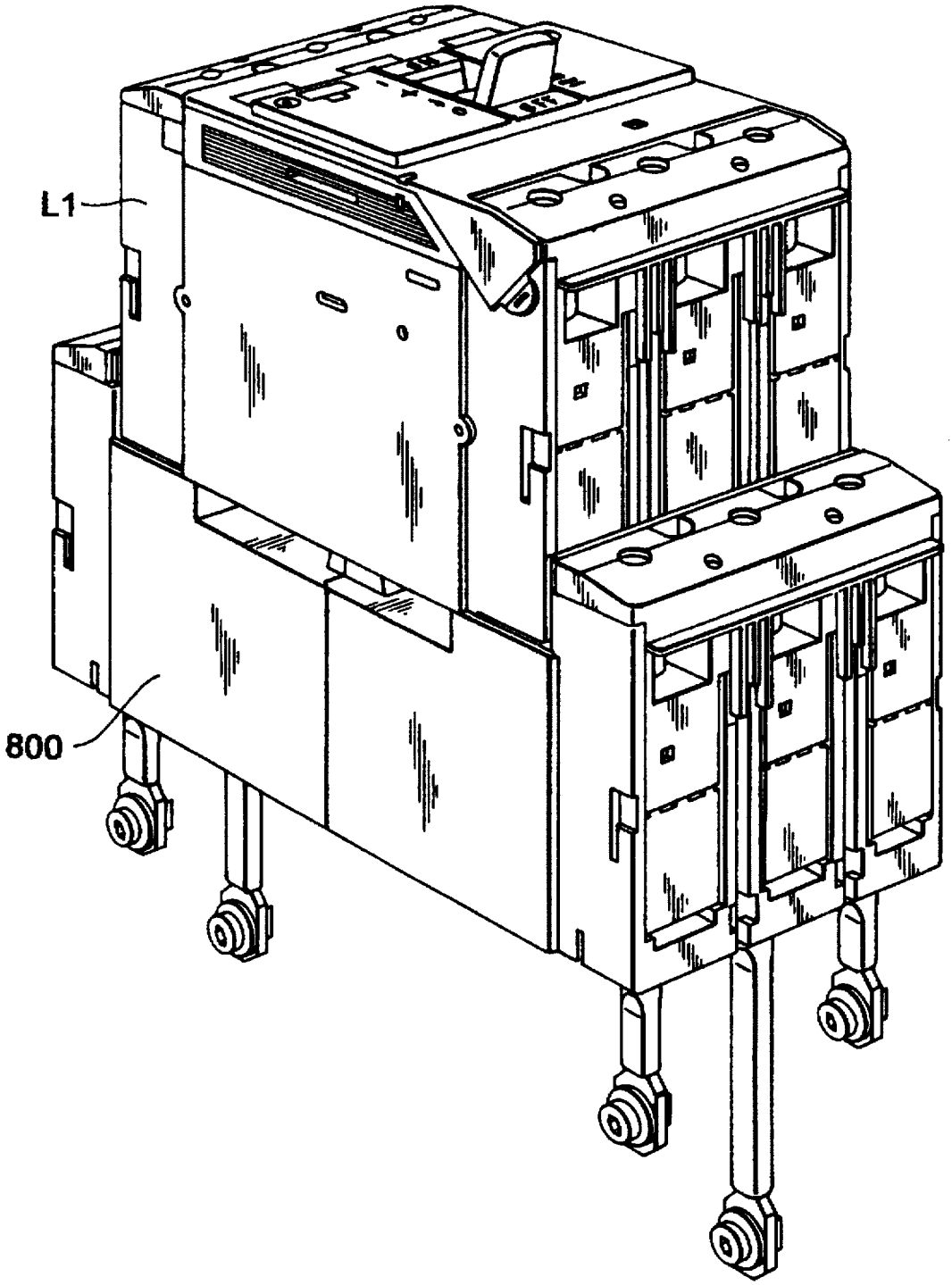
FIG. 8 shows a mechanical switching device installed on a plug-in pin base.
Figure 9:
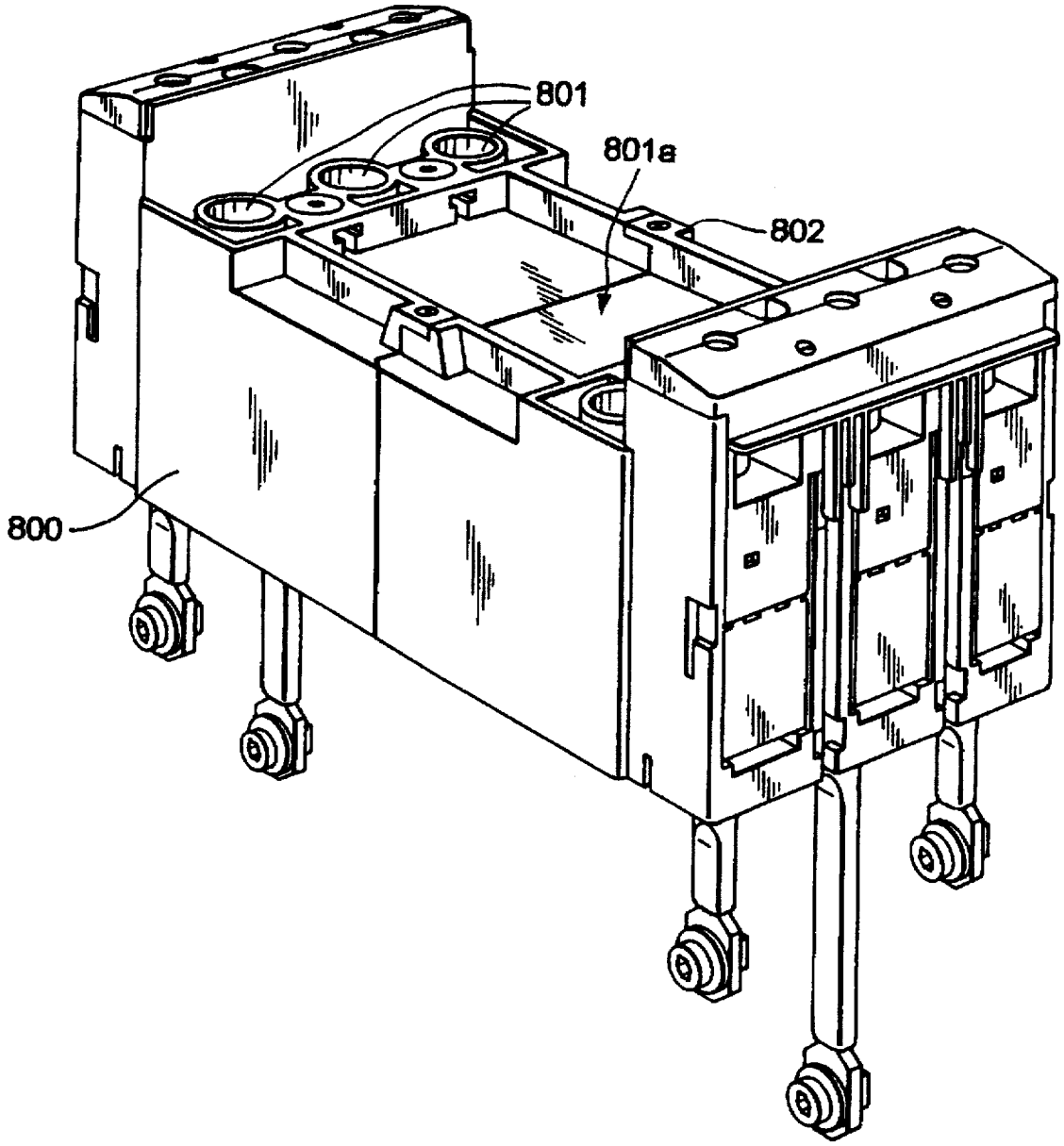
FIG. 9 shows the plug-in pin base of FIG. 8.

For the embodiment of a mechanical switching device L which can be plugged into a socket S1 as illustrated in FIG. 7, the configuration of recesses on the underside of the mechanical switching device L is essentially not necessary, if the plug-in pin base S1 has been realized so that it has a corresponding recess 102. In that case, the depth of the recess 102 can preferably correspond to the amount of space required by the head 501 and the compressed compression spring 60 of the safety plunger 50 in the installed position, i.e. when the power circuit breaker L is fully inserted into the plug-in pin base S1. FIGS. 8–19 show an additional embodiment of the present invention. FIG. 8 shows a mechanical switching device L1 assembled onto a plug-in base 800, and FIG. 9 shows the switching device L1 absent or removed from the plug-in base 800, so that the interior of the plug-in base 800 is exposed.

Figure 10:
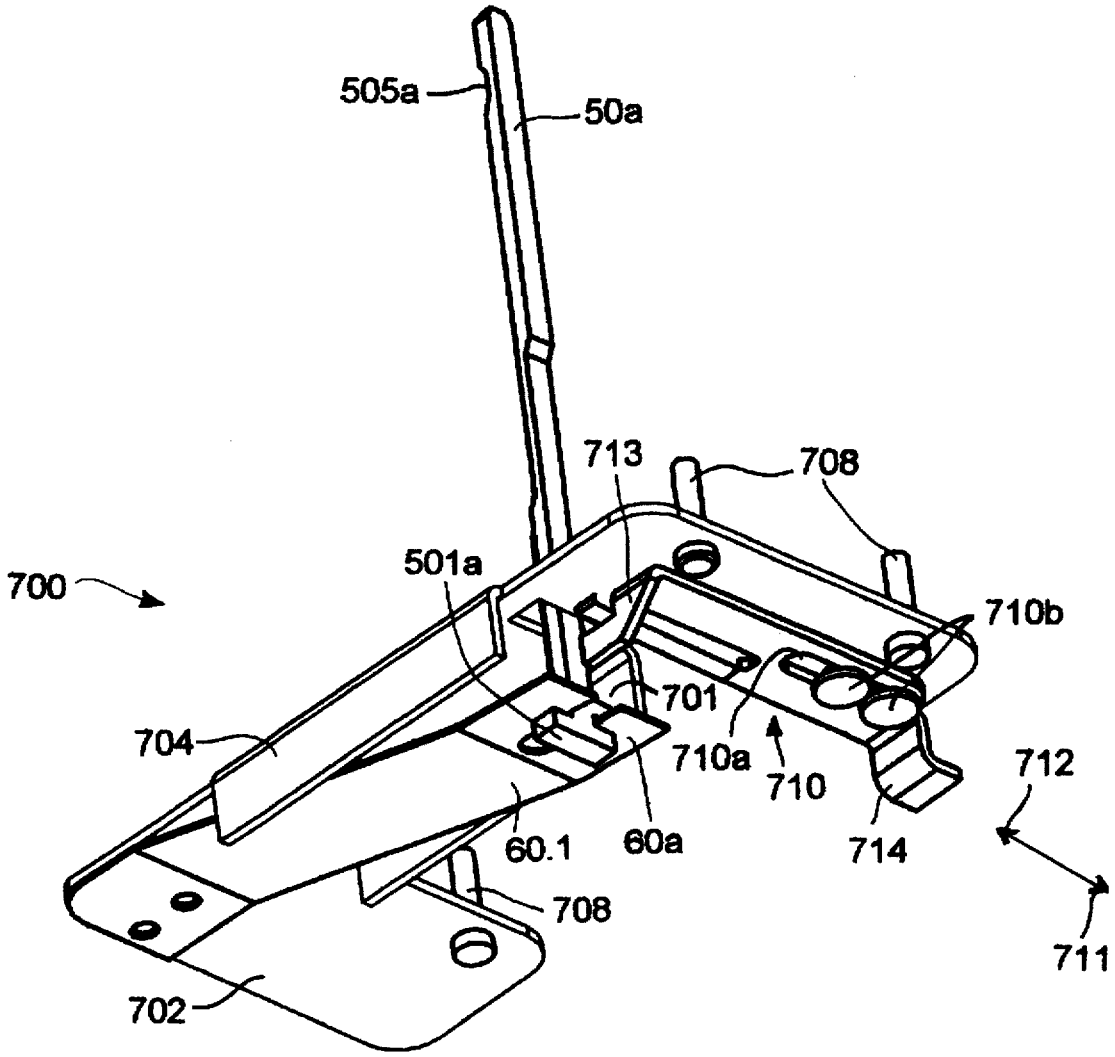
FIG. 10 shows a component including a safety plunger which can be installed on the bottom part of the switching device of FIG. 8.

In this embodiment, and with reference to FIG. 10, there can preferably be a pre-assembled component 700 which can be installed at the factory on a bottom part 900 (see FIG. 11) of the housing of the switching device L1. Alternatively, the component 700 can be retrofitted into the switching device L1 by the user. The component 700 includes a safety plunger 50*a*, a mounting plate 702 having a bevelled protection plate 704, and a leaf spring 60.1. The leaf spring 60.1 can preferably be connected on one side to the mounting plate 702, and on the other end can be associated with a terminal end 501*a* of the safety plunger 50*a*. The component 700 can also include a stopper 710, which stopper 710 can be fastened to the mounting plate 702 so as to be movable. The stopper 710 can be moved with respect to the mounting plate 702 by means of a longitudinal slot 710*a* disposed in the stopper 710, in which slot 710*a* one or more pins or fastening elements 710*b* can engage, which fastening elements 710*b* can preferably be fixed on mounting plate 702. The fastening elements 710*b* can have heads having diameters which are larger than the width of the slot 710*a*, in order to prevent the stopper 710 from detaching from the mounting plate 702, while still permitting longitudinal movement of the stopper 710. The stopper 710 can also preferably include a first bent leg 713 and a second bent leg 714 disposed opposite one another, the second bent leg 714 being located near the slot 710*a* and fastening elements 710*b*.

Figure 11:
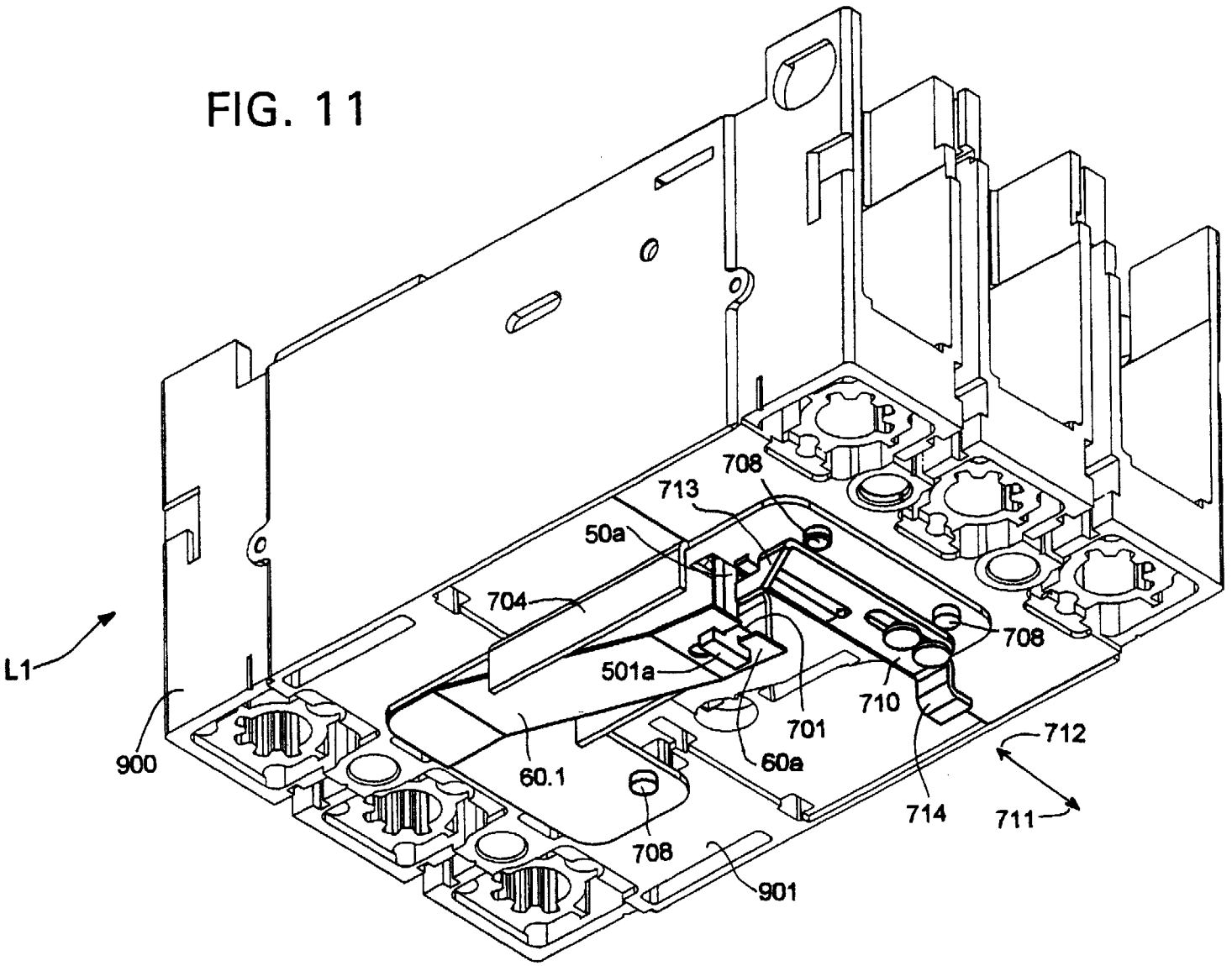
FIG. 11 shows the component of FIG. 10 installed on the switching device of FIG. 8.
Figure 13:
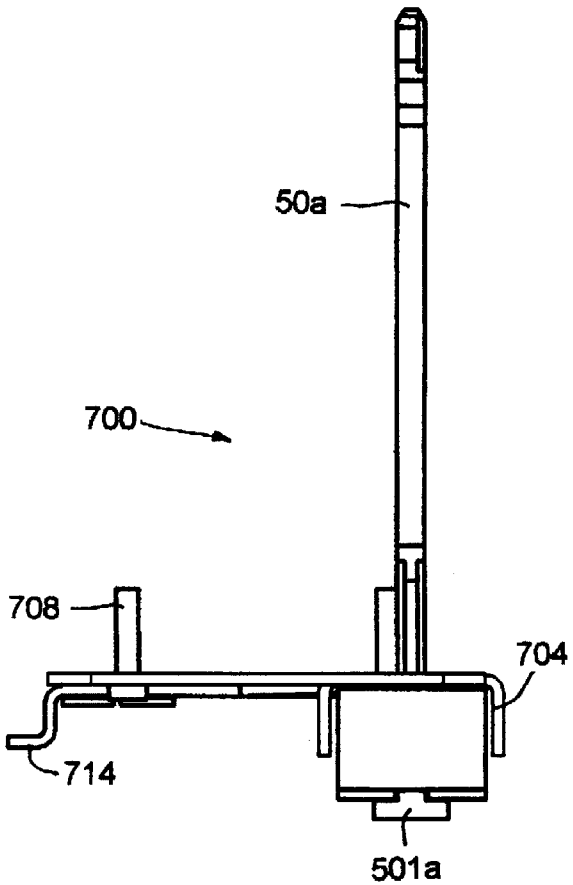
FIG. 13 shows a view "C" of the component shown in FIG. 12.
Figure 12:
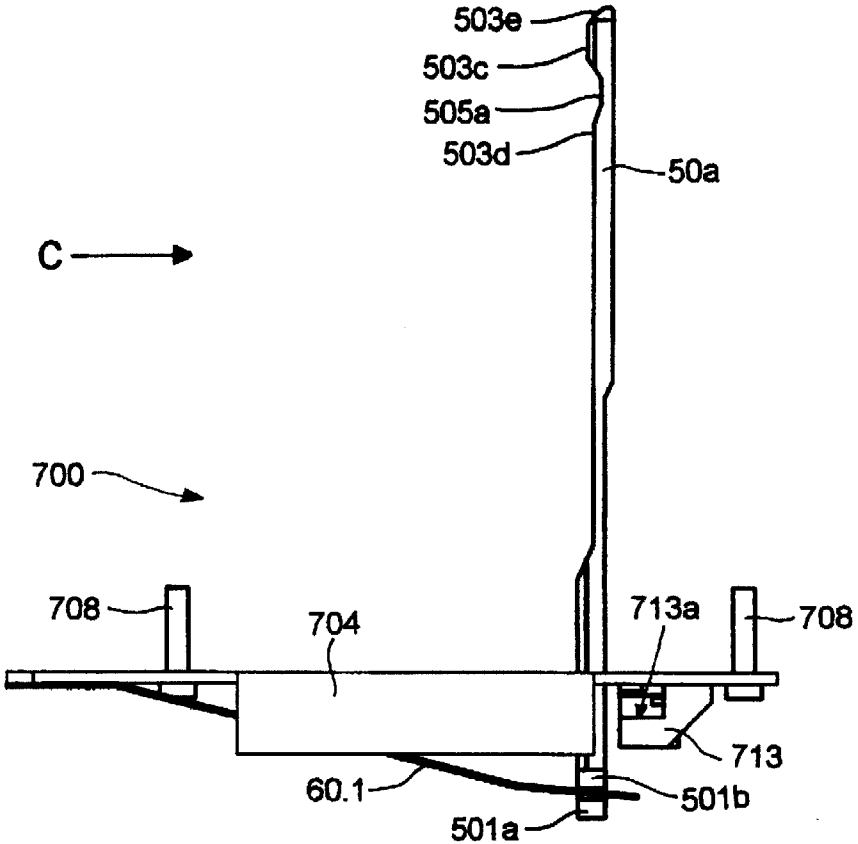
FIG. 12 shows a side view of the component of FIG. 10.
Figure 14:
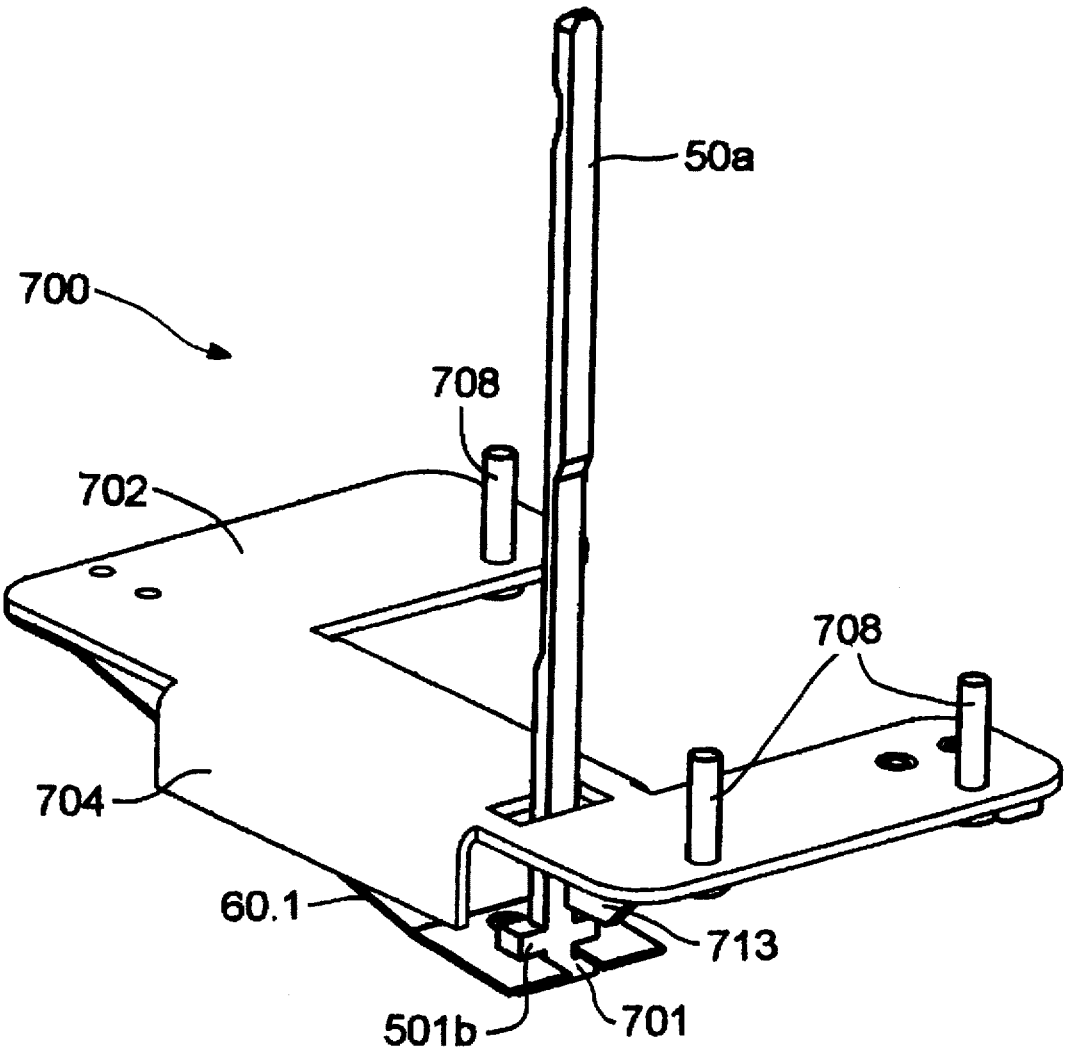
FIG. 14 shows an additional perspective view of the component of FIG. 10.
Figure 15:
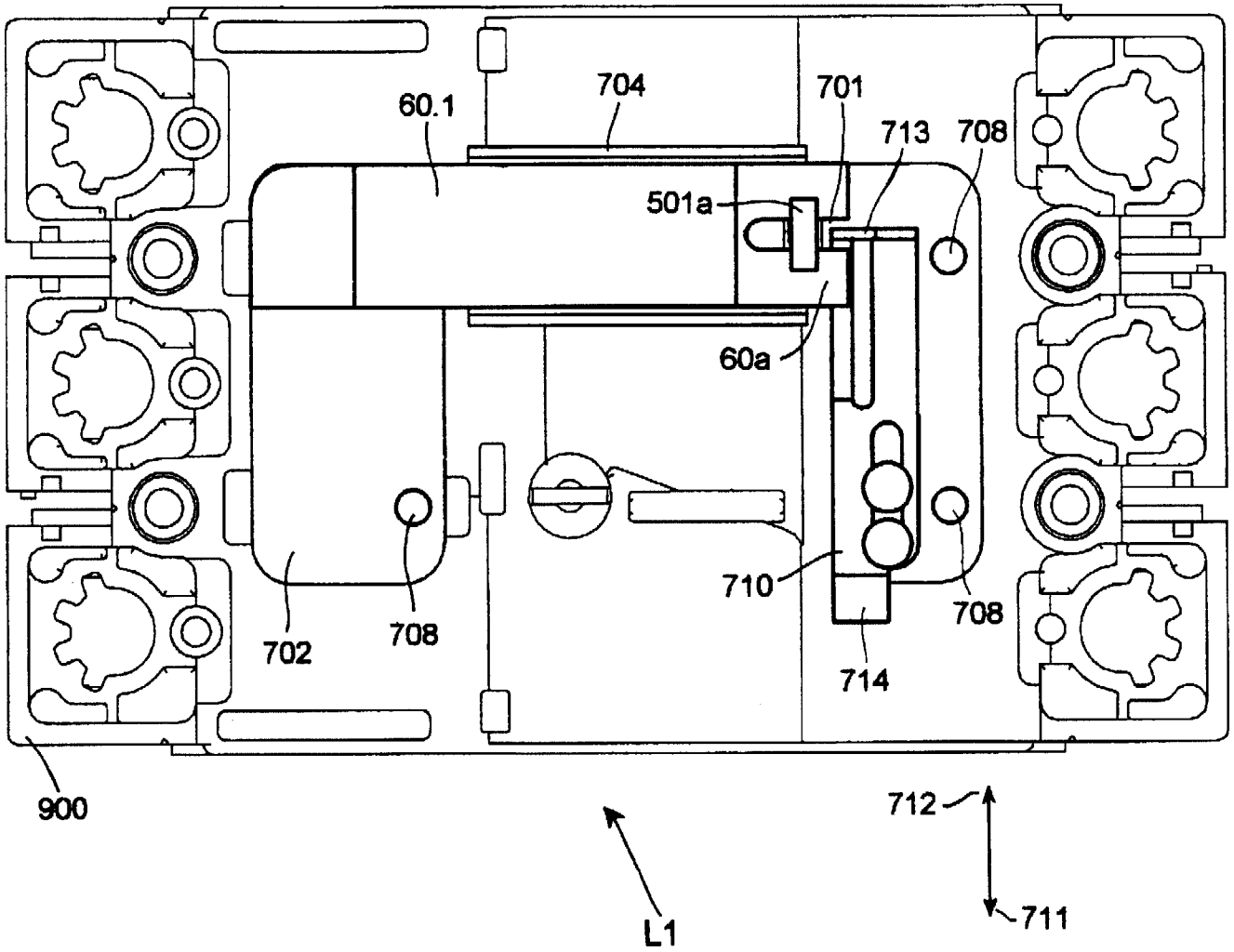
FIG. 15 shows a bottom view of the switching device of FIG. 8, with the component of FIG. 10 installed thereon.
Figure 16:
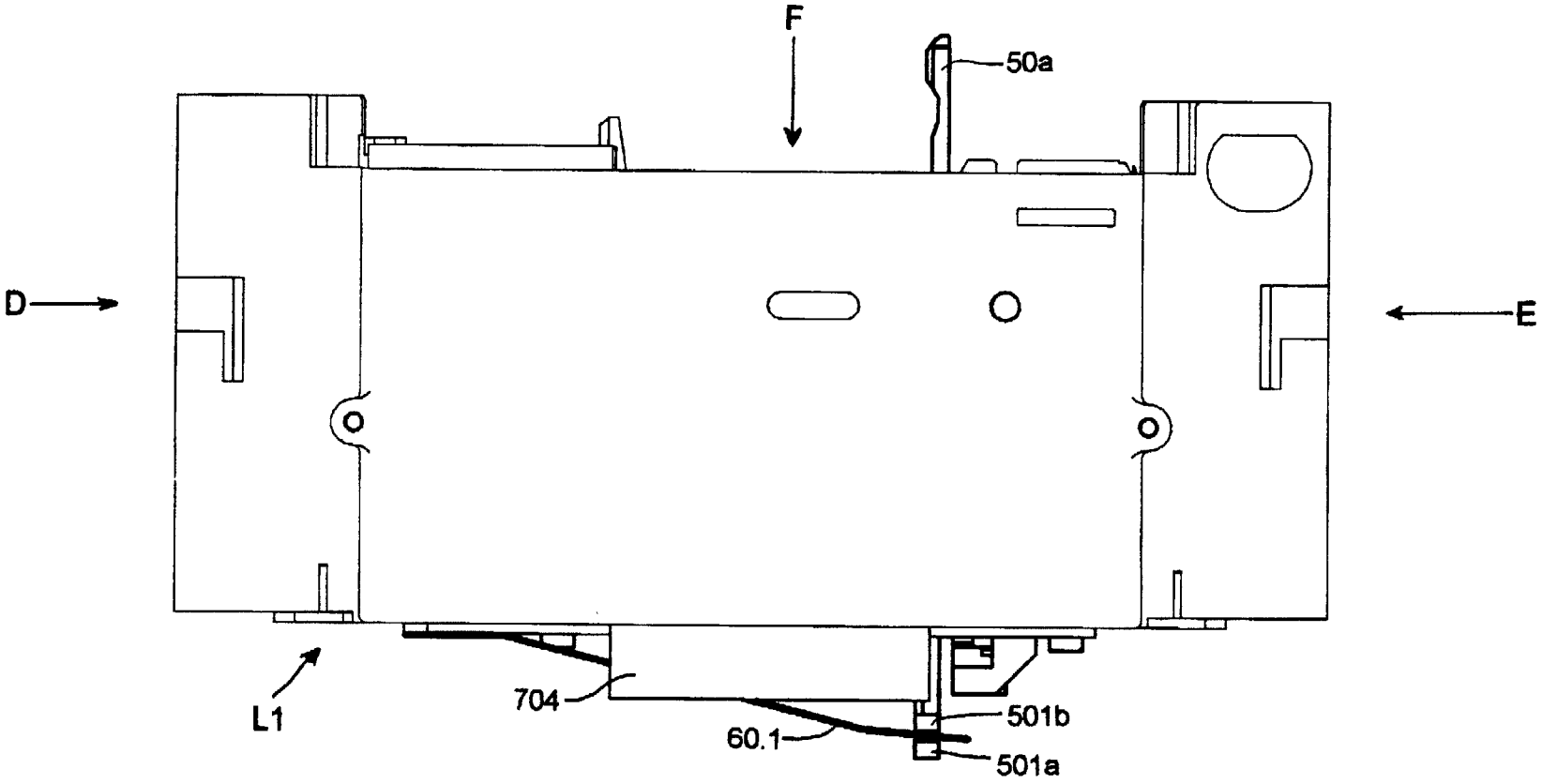
FIG. 16 shows a side view of the switching device of FIG. 8, with the component of FIG. 10 installed thereon.
Figure 17:
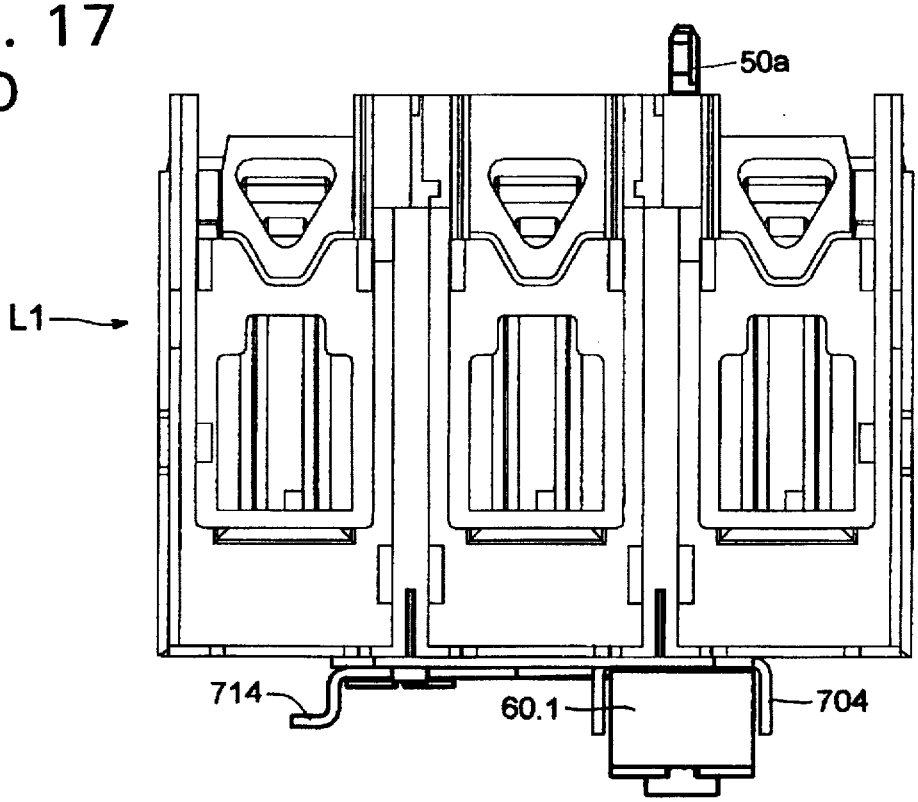
FIG. 17 shows a view "D" of the switching device and component of FIG. 16.
Figure 18:
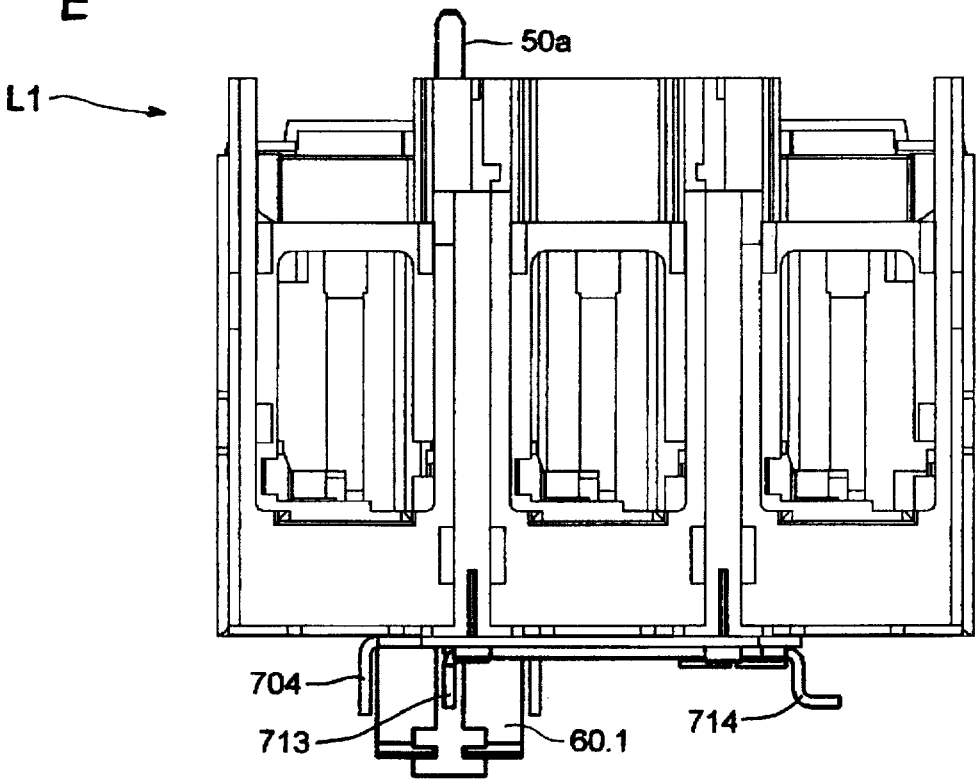
FIG. 18 shows a view "E" of the switching device and component of FIG. 16.
Figure 19:
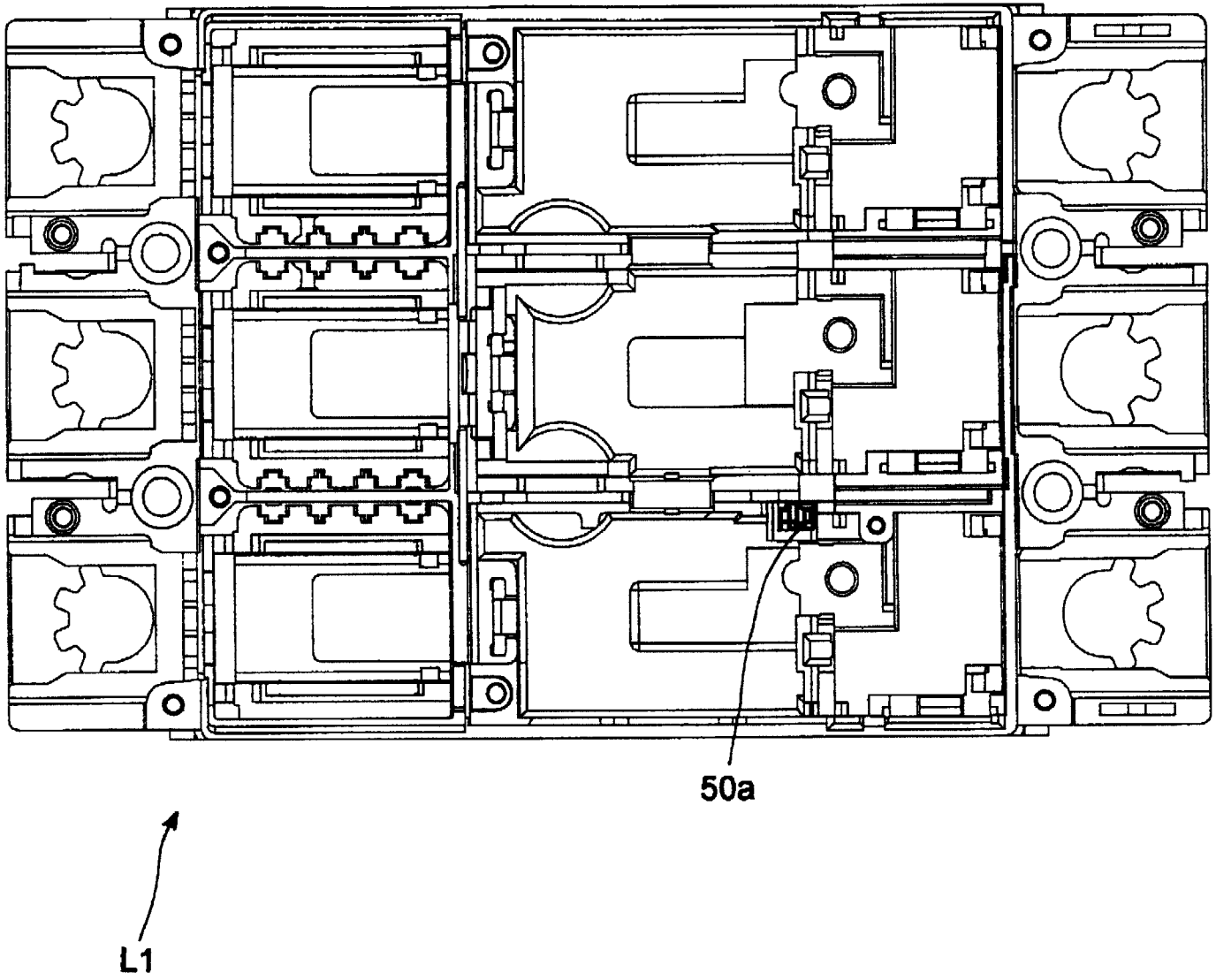
FIG. 19 shows a top view "F" of the switching device of FIG. 16.

As best shown in FIG. 11, the component 700 can be fastened by means of screws 708 on a back side 901 of the switching device L1, in which position the component 700 along with safety plunger 50*a* extends into the switching device L1.

The protection plate 704 can serve to protect the end of the safety plunger 50*a*, which projects out of the switching device L1, from damage. The protection plate 704 can, in accordance with one embodiment extend in a direction away from mounting plate 702, and can be essentially perpendicular to mounting plate 702.

The leaf spring 60.1 can act similarly to the compression spring 60 discussed hereinabove, however, when the switching device L1 of FIGS. 8–19 is installed on the plug-in base 800, the installation depth required for the leaf spring 60.1 can preferably be less than that required by the compression spring 60.

When the switching device L1 has been removed from the plug-in base 800 and separated from main connections 801 of the plug-in base 800 (see FIG. 9), the switching device L1 can, if desired, be tested by qualified technical personnel. For this purpose, the leaf spring 60.1 can be pushed by hand toward the back side 901 of the switching device L1, and the stopper 710 can be pushed in the direction indicated by the arrow 711, so that the stopper 710, with its first bent leg 713, moves behind the free end of the loaded leaf spring 60.1 so that the safety plunger 50*a* cannot cause a tripping of the switching device L1. In this state, the switching device L1 cannot be mounted on the plug-in base 800, and thus cannot be connected incorrectly to the main connections 801, since, if an attempt is made to plug in the switching device L1, the second bent leg 714 of stopper 710 would be placed against an edge 802 of the plug-in base 800 (see FIG. 9), thus blocking the attempt.

When the stopper 710 is pulled back in the direction indicated by the arrow 712, the first leg 713 can move into a gap 701 located at the free end of the leaf spring 60.1, so that the leaf spring 60.1 can be released by the stopper 710, and the second leg 714 no longer blocks the plugging-in of the switching device L1.

In accordance with one embodiment, the safety plunger 50*a* shown in FIGS. 10–19 can preferably have only one depression 505*a* and can also have at least one control cam 503*c*, and possibly what can be considered to be an additional control cam 503*d* on either side of the depression 505*a*. In addition, the safety plunger 50*a* shown in FIGS. 10–19 does not have a stop 506, since, in this embodiment, the leaf spring 60.1 can serve to limit the movement of the plunger 50*a* out of the switching device L1 by contact with a flanged portion 501*b* (see FIGS. 14 and 16) of the safety plunger 50*a*. The flanged portion 501*b* of the safety plunger 50*a* can preferably have a similar shape as the head 501*a*.

In accordance with one embodiment of the present invention, the safety plunger 50*a* shown in FIGS. 10–19 can preferably operate similarly to the plunger 50 discussed hereinabove. That is, once the component 700 is installed on the bottom 900 of the switching device L1, when the switching device L1 is moved in direction M1 towards the plug-in base 800, the head end 501*a* of the plunger 50*a* can eventually come into contact with a surface 801*a* of base 800 (see FIG. 9). The contact between the head 501*a* and the surface 801*a* can then cause the safety plunger 50*a* to move further into the switching device L1. In this case, the latching lever 251 (not shown here for purposes of simplicity) can initially be positioned so as to contact control cam 503*c*, i.e. when the switching device L1 has been completely removed from the base 800. Then, as the plunger 50*a* is pushed into the switching device L1, the lever 251 with its lug 252 can slide across control cam 503*c*, and while doing so, can essentially have no effect on the latching mechanism 25 of the switching device L1. Once the lever 251 and lug 252 reach the depression 505*a*, however, the lever 251 can preferably execute a rotational or pivoting movement which would correspond to direction D2 in FIGS. 5 and 5A, i.e. clockwise. This movement of lever 251 in direction D2 can preferably cause an unlatching the latch 25 of the latching mechanism of the switch lock 10. This unlatched position of the switch lock 10 can be maintained until the lug 252 moves out of the depression 505A and onto control cam 503*d*.

Once the lug 252 moves onto control cam 503*d* and the plunger 50*a* has thus reached its limit position (i.e. the mechanical switching device L1 is inserted all the way into the base 800), the lever 251 can preferably execute a rotational movement in the direction D1 shown in FIGS. 5 and 5A. That is, in accordance with one embodiment, the lever 251 can preferably cause the latch 25 to rotate in direction D1 and the switch lock 10 can thus be "relatched", or alternatively, the lever 251 can move the latch 25 in the direction D1, and then breaker L1 would then have to be "cocked" by hand in order to completely reset the latch 25. Alternatively, the lever 251 may be connected to the latch 25 so that lever 251 and latch 25 rotate with one another in direction D2 to "trip" the switching device L, and in direction D1, the lever 251 may be pivotable with respect to the latch 25, which means that the latch 25 may not be rotatable along with lever 251 in direction D1, but would instead need to be "recocked" or reset by hand. Thus, in accordance with this embodiment, the lever 251 would essentially only serve to "trip" the switching device L, and would not, by itself, reset the latch 25 of the switching device L.

The removal of the switching device L1 from the base 800 can essentially take place the reverse direction from that just described.

Alternatively, in accordance with an additional embodiment, the lever 251 and lug 252 could conceivably be initially disposed at a point 503*e* adjacent control cam 503*c* (see FIG. 12), which point 503*e* could be considered to be a depression, wherein the positions of the lug 252 in relation to the safety plunger 50*a* as the safety plunger 50*a* moves further into the switching device L1 would essentially correspond to that shown in FIGS. 5 and 5A at positions "a"–"e". That is, the switching device L1 can be "tripped" when the lug 252 moves from point 503*e* to cam 503*c*, and "relatched" when lug 252 moves from cam 503*c* to depression 505*a*. Thus, in accordance with this embodiment, with reference to FIG. 5, point or depression 503*e* would be equivalent to depression 505, cam 503*c* would be equivalent to cam 502, and depression 505*a* would be equivalent to depression 504.

The leaf spring 60.1 in this embodiment can preferably serve to bias the end 501*a* of the safety plunger 50*a* away from the bottom 901 of the switching device L1, similar to compression spring 60 discussed hereinabove. In addition, as discussed above, the position of the safety plunger 50*a* in this embodiment can be "locked", for example when the switching device L1 has been removed from the base 800 and testing of the switching device L1 is needed or desired. In this case, the leaf spring 60.1 can be pushed by hand towards the back side 901 of the switching device L1, and the stopper 710 can be moved in the direction 711 so that a surface 713*a* of leg 713 (see FIG. 12) comes into contact with a surface 60*a* of leaf spring 60.1 (see FIG. 15). Otherwise, in accordance with one embodiment, when the switching device L1 is installed on the base 800, is being removed from the base 800, or is being installed on the base 800, the free end of the leaf spring 60.1 should preferably be free to move (i.e. the leg 713 is aligned with the gap 701 in the leaf spring 60.1).

Figure 20:
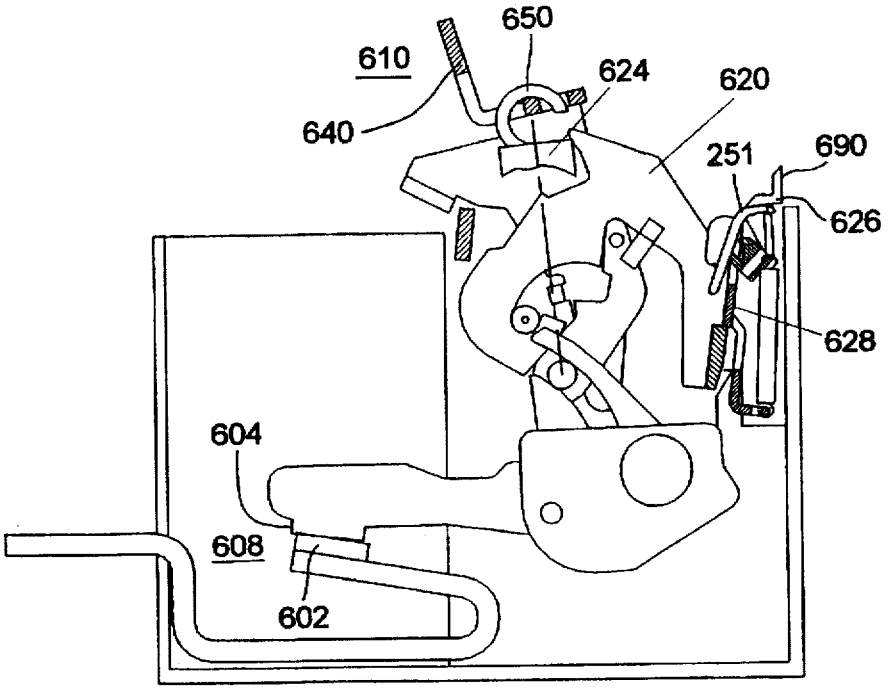
FIG. 20 shows a breaker mechanism with a corresponding contact system in which the present invention may be utilized, with the breaker mechanism in the closed position.
Figure 21:
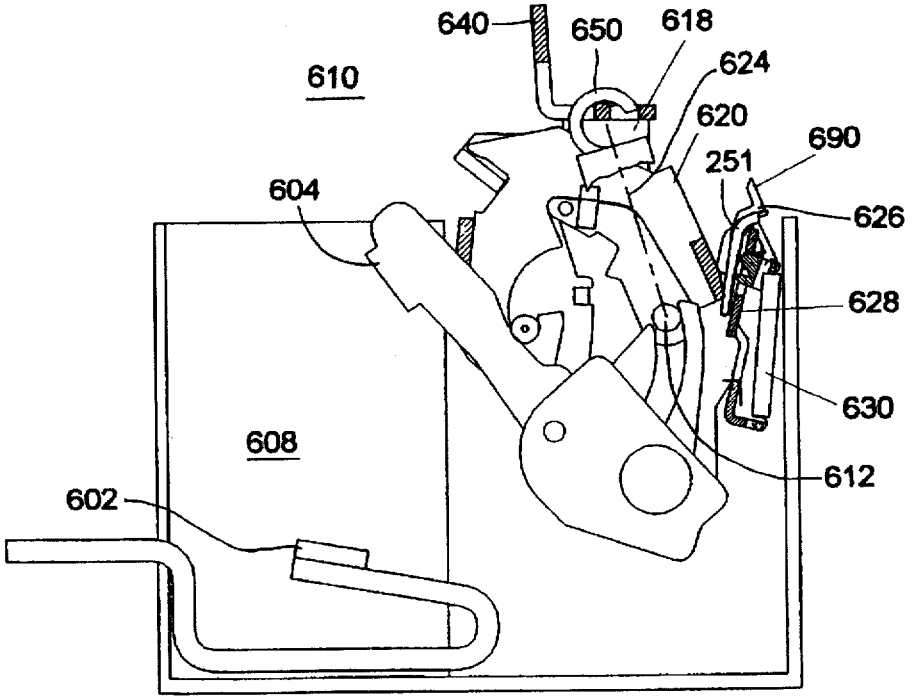
FIG. 21 shows the breaker mechanism of FIG. 20 in the tripped position.

FIGS. 20 and 21 show a side views of a circuit breaker mechanism 610 with a corresponding contact system, in which the present invention may be utilized. FIG. 20 shows the breaker 610 in the "closed" position, and FIG. 21 shows the breaker 610 in the "tripped" position. The specific functioning of this type of breaker mechanism 610 is discussed in detail in U.S. Pat. No. 5,369,384, which is hereby incorporated by reference, and will not be discussed in detail here except with regard to the latching mechanism 626, 628.

The breaker mechanism 610 shown in FIGS. 20 and 21 can have three contact systems 608, each of the three contact systems 608 having a stationary contact carrier with a welded-on stationary contact tip 602 as well as a moving contact arm with a welded-on moving contact tip 604. The breaker mechanism 610 can also include a bent flange 640 for fastening a breaker handle (not shown here), two breaker plates (also not shown), a connecting element 618, a bracing lever 620, two toggle levers (not shown), a connecting shaft 612, a coil shaped toggle lever spring 624, a latch 626, a latch lever 628, and a latch spring 630. One end 650 of spring 624 can be attached to flange 640, and the other end of spring 624 can be attached to shaft 612.

The latch 626 can have a trip surface 690 which is configured to absorb the tripping movement of a magnetic or thermal trip (not shown). Rapid locking and latching of the latch 626 and the latch lever 628 can be facilitated by a rather strong prestress from the latch spring 630. The latch 626 can, in accordance with one embodiment, be similar to the latch 25 of the present invention, and can preferably be pivotable between "tripped" and "untripped" positions. The lever 251 of the present invention is shown in FIGS. 20 and 21, and can be non-rotatably attached to the latch 626. The safety plunger 50 is not shown in FIGS. 20 and 21 for purposes of simplicity, but would interact with the lever 251 and lug 252 as discussed above with reference to FIGS. 5 and 5A.

FIG. 20 shows the breaker mechanism 610 in the "on" position, i.e. the movable contacts 604 are in contact with the stationary contacts 602. If, for example, the breaker mechanism 610 were being installed onto a base or plate, as the breaker 610 is moved closer and closer to the base or plate, the plunger 50 would move further into the breaker 610, thus causing the lug 252 of lever 251 to move from the depression 505 (see FIGS. 5 and 5A) to the control cam 502. This movement of the lug 252 would then cause the lever 251 to move in direction D1 (FIGS. 5 and 5A). Since the lever 251 is non-rotationally attached to the latch 626, the latch 626 would also be moved in direction D1, and thus the breaker 610 would "trip". The resulting position of the latch 626 and lever 251 are shown in FIG. 21, which shows the "tripped" state of the breaker 610, wherein the contacts 602 and 604 are now separated from one another and the flange 640 (which would have an operating handle attached) to move into the "open" or "off" position. The further movements of the safety plunger 50*a* would then be the same as that discussed further above with reference to FIGS. 5 and 5A.

In accordance with one embodiment of the present invention, with further reference to FIGS. 5 and 5A, the progression of the lever 251 at positions "d" and "e" wherein the lever 251 executes a movement in direction D2 upon entering the second depression 504, it is conceivable that the movement of the lever 251 will cause latch 25 to be "reset" wherein no further "cocking" of the switching device L or breaker would be necessary in order to reset latch 25. However, it is also possible that upon the lug 252 of the lever 251 entering the second depression 504, that the lever 251 would move latch 25 in direction D2, but the breaker would have to be "cocked" by hand by means of the breaker handle (which would be attached to flange 640 (FIGS. 20 and 21) or rocker arm 11*a*, in order to reset the latch 25 of the latching mechanism in its proper position. Alternatively, as mentioned above, the lever 251 may be connected to latch 25 so that the lever 251 and latch 25 rotate along with one another in direction D1 to "trip" the latch 25, but the lever 251 may be pivotable with respect to latch 25 in direction D2 (i.e. the lever 251 cannot move the latch 25 in direction D2), so that the switching device L would have to be reset or "cocked" by hand. Further, it is also possible that lever 251 is biased in direction D2, for example by a spring or other means (such as spring 630 in FIGS. 20 and 21).

One feature of the invention resides broadly in the safety device for the mounting on a mounting surface, such as a plug-in pin base, mounting plate or mounting rail, of a mechanical switching device which has movable contacts with a correspondingly configured connection surface, an actuator mechanism with a rocker arm, switch lock and latching mechanism for the movable contacts of the mechanical switching device, containing a safety plunger which is located in the mechanical switching device and can be moved in opposition to a spring force, which safety plunger is linked by means of one terminal area with the latching device of the switch lock and which can be extended with its other terminal area out of the mechanical switching device and causes a tripping of the mechanical switching device when the mechanical switching device is removed from the mounting surface, characterized by the fact that the terminal area of the safety plunger 50 which is linked with the latching mechanism 25 has an operating cam with at least one oblong and bilaterally bevelled control cam 502, 503 which is bevelled on both sides.

Another feature of the invention resides broadly in the safety device characterized by the fact that the terminal area of the safety plunger which is linked with the latching mechanism 25 has an operating cam with a plurality of control cams 502,503 located one after another in the longitudinal direction of the safety plunger 50.

Another feature of the invention resides broadly in the safety device characterized by the fact that the latching mechanism has a latch 25 which is mounted so that it can rotate or move to establish the tripped position of the mechanical switching device, which latch 25 is linked to the operating cam of the safety plunger 50, and whereby during the installation or removal of the mechanical switching device, as a result of the movement of the safety plunger 50, the operating cam of the safety plunger can move along the latch 25 and a rotational movement or displacement of the latch 25 can be produced which guarantees that the mechanical switching device is in the tripped position during the installation or removal process.

Yet another feature of the invention resides broadly in the safety device characterized by the fact that the tripped state can be produced when the linkage is established between the latching mechanism 25 and control cams 502, 503 of the safety plunger 50, and the untripped state of the mechanical switching device can be produced when the linkage is established between the latching mechanism 25 and a latching depression 504, 505 formed by the remaining part of the operating cam and between the control cams.

Still another feature of the invention resides broadly in the safety device characterized by the fact that when the mechanical switching device is removed, the extendable terminal area 501 of the safety plunger 50 is moved in response to the action of a spring into a position where it extends beyond the connection surface 200 of the mechanical switching device.

A further feature of the invention resides broadly in the safety device characterized by the fact that when the mechanical switching device is installed, the extendable terminal area 501 of the safety plunger 50 is in a position in which it is supported against the mounting surface 100 and is retracted into the mechanical switching device against the spring force.

Another feature of the invention resides broadly in the safety device characterized by the fact that on the connection side 200 of the mechanical switching device there is a recess 111, 112 which has at least one step for the location of the terminal area 501 of the safety plunger 50 and the compression spring 60 when the mechanical switching device is in the installed position.

Yet another feature of the invention resides broadly in the safety device characterized by the fact that the longitudinal axis X of the safety plunger 50 is axially parallel to the direction of insertion and extraction respectively M1, M2 of the mechanical switching device, and to the direction of movement P1, P2 of the safety plunger 50.

Still another feature of the invention resides broadly in the safety device characterized by the fact that the safety plunger 50 is enlarged to form a head on its terminal area 501 which can be extended beyond the connection surface 200 of the mechanical switching device.

A further feature of the invention resides broadly in the safety device characterized by the fact that the safety plunger 50, in the area of its longitudinal extension, has a projecting stop 506 or similar device which interacts with a corresponding abutment 116 in the mechanical switching device to prevent the safety plunger 50 from falling out of the mechanical switching device.

Examples of switch latches and latching mechanisms which may be utilized in accordance with the present invention may be disclosed in the following U.S. Pat. Nos. 5,444,423 to Venzke et al. on Aug. 22, 1995, entitled "Latch Mechanism for a Circuit Breaker"; No. 5,428,329 to Grunert on Jun. 27, 1995, entitled "Springclip Means for a Latchable Operating Mechanism on a Circuit Breaker"; No. 5,392,016 to Arnold et al. on Feb. 21, 1995, entitled "Molded Case Circuit Breaker Mechanical Rating Plug"; No. 5,182,532 to Klein on Jan. 26, 1993, entitled "Thermal-magnetic Trip Unit"; No. 5,220,303 to Pannenborg et al. on Jun. 15, 1993, entitled "Molded Case Circuit Breaker Low Friction Latch Assembly"; 5,280,258 to Opperthauser on Jan. 18, 1994, entitled "Spring-powered Operator for a Power Circuit Breaker"; No. 5,290,982 to Beck et al. on Mar. 1, 1994, entitled "Circuit Breaker With Positive On/Off Interlock"; and No. 5,294,901 to Tacinelli et al. on Mar. 15, 1994, entitled "Molded Case Circuit Breaker Insulated Armature Latch Arrangement".

Examples of circuit breakers, and components found therein, which may be utilized in accordance with the embodiments of the present invention, may be found in the following U.S. Pat. No. 4,750,375 to Godesa, entitled "Drive Device for a Circuit Breaker with a Ratchet Wheel"; No. 4,678,873 to Preuss and Berndt, entitled "Low Voltage Circuit Breaker . . . "; No. 4,380,785 to Demayer and Claudin, entitled "Solid State Trip Unit . . . "; No. 4,695,913 to Terracol and Roulet, entitled "Shunt Effect Low Voltage Circuit Breaker"; No. 5,296,664 to Crookston et al., entitled "Circuit Breaker with Positive Off Protection"; and No. 5,369,384 to Heins, entitled "Power Circuit Breaker with a Breaker Mechanism and a Breaker Mechanism for a Power Circuit Breaker".

Additional examples of circuit breakers and components associated therewith which may be utilized in accordance with the present invention may be disclosed in the following U.S. Pat. No. 4,835,842 to Castonguay et al. on Jun. 6, 1989, entitled "Method of Assembling a Molded Case Circuit Breaker Operating Mechanism"; No. 5,200,725 to Arnold et al. on Apr. 6, 1993, entitled "Molded Case Circuit Breaker Multi-pole Crossbar Assembly"; No. 4,888, 570 to Toda on Dec. 19, 1989, entitled "Circuit Breaker"; No. 3,005,066 to Powell on Oct. 17, 1961, entitled "Circuit Breaker"; No. 3,147,352 to Giessner et al. entitled "Automatic Circuit Breaker with Contact Arm Ball Joint"; No. 3,152,232 to Leonard entitled "Circuit Breaker Having Bimetal Rigidly Secured to Cradle"; No. 4,151,495 to Rys et al. on Apr. 24, 1979, entitled "Resetting Means for Trip Free Circuit Breaker Contact Operating Mechanism"; and No. 4,736,174 to Castonguay et al. on Apr. 5, 1988, entitled "Molded Case Circuit Breaker Operating Mechanism".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 295 06 151.0, filed on Apr. 8, 1995, having inventor Kurt Handler, and DE-OS 295 06 151.0 and DE-PS 295 06 151.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A mechanical switching device for being removably mounted on a mounting structure, said switching device comprising:

a housing;

a contact system disposed within said housing;

said contact system comprising a movable contact portion and a stationary contact portion;

both of said movable contact portion and said stationary contact portion being disposed within said housing;

both of said movable contact portion and said stationary contact portion being removable from a mounting structure along with said housing upon said switching device being removed from a mounting structure and installable on a mounting structure along with said housing upon said switching device being installed on a mounting structure;

apparatus to engage said movable contact portion with said stationary contact portion to provide a closed position of said switching device and to disengage said movable contact portion from said stationary contact portion to provide an open position of said switching device;

apparatus to move said contact system into a tripped position wherein said movable contact portion is disengaged from said stationary contact portion upon said switching device being installed on a mounting structure and upon said switching device being removed from a mounting structure;

said apparatus to move comprising:

a latching mechanism operatively connected to said movable contact portion and being disposed to move said switching device into said tripped position;

a safety plunger having a longitudinal axis, a first end, and a second end disposed a substantial longitudinal distance from said first end;

said first end of said safety plunger for being disposed adjacent a mounting structure;

said second end of said safety plunger being operatively connected to said latching mechanism; and said second end of said safety plunger comprising at least one cam having at least one portion extending along the longitudinal axis of said safety plunger.

2. The switching device according to claim 1 wherein:

said at least one portion of said cam comprises a cam surface;

said cam surface comprising a first side and a second side disposed a substantial longitudinal distance from one another;

said at least one cam comprises:

a first bevel disposed adjacent said first side of said cam surface; and a second bevel disposed adjacent said second side of said cam surface; and said cam surface extending between said first bevel and said second bevel.

3. The switching device according to claim 2 wherein:

said latching mechanism comprises a latch, said latch being mounted for rotation and having an axis of rotation;

said latch being rotatable in a first rotational direction and a second rotational direction about the axis of rotation, the first rotational direction being opposite the second rotational direction;

said safety plunger being movable in a first direction during installation of said switching device on a mounting structure and a second direction during removal of said switching device from a mounting structure, the first direction being opposite the second direction; and said cam being in contact with said latch such that, upon movement of said safety plunger in said first and second directions, said cam moves along said latch and moves said latch in said first rotational direction to move said switching device into said tripped position during removal of said switching device from a mounting structure and during installation of said switching device on a mounting structure.

4. The switching device according to claim 3 wherein:

said housing comprises a bottom portion for being disposed adjacent a mounting structure, said bottom portion comprising a connection surface disposed adjacent said first end of said safety plunger;

said apparatus to move comprising a device to bias said safety plunger, said device to bias being disposed to provide a biasing force on said first end of said safety plunger in a direction away from said connection surface; and said first end of said safety plunger extending out of said housing during removal of said switching device from a mounting structure.

5. The switching device according to claim 4 wherein during installation of said switching device on a mounting structure said first end of said safety plunger is moved towards said connection surface by a mounting structure against the biasing force of said device to bias.

6. The switching device according to claim 5 wherein:

said first end of said safety plunger comprises an enlarged head, said enlarged head extending beyond said connection surface at least during removal of said switching device from a mounting structure;

said switching device being removable from a mounting structure in a first removal direction and being installable on a mounting structure in a second installing direction, the first removal direction being opposite the second installing direction; and said apparatus to move being configured such that the longitudinal axis of said safety plunger is substantially parallel with respect to all of: the first removal direction; the second installing direction; the first direction of movement of said safety plunger and the second direction of movement of said safety plunger.

7. The switching device according to claim 6 wherein:

said cam comprises a first depression and a second depression, said first depression being disposed adjacent said first side of said cam surface, said first bevel forming a transition between said cam surface and said first depression;

said second depression being disposed adjacent said second side of said cam surface, said second bevel forming a transition between said cam surface and said second depression; and said switching device being in said tripped position upon said latch being in contact with said cam surface, and said switching device being in an untripped position upon said latch being in contact with one of said first and second depressions.

8. The switching device according to claim 7 wherein:

said safety plunger comprises an intermediate portion disposed between said first end and said second end of said safety plunger, said intermediate portion comprising a stop extending outwardly from said intermediate portion; and said switching device further comprising an abutment disposed within said housing and adjacent said intermediate portion of said safety plunger, said abutment being disposed to engage with said stop to prevent said safety plunger from exiting said bottom portion of said switching device.

9. The switching device according to claim 8 wherein said device to bias comprises a spring, said spring being disposed immediately adjacent said enlarged head of said safety plunger and being disposed about said first end of said safety plunger;

said connection surface comprising a recess disposed therein, said recess having a cross-section, taken along the longitudinal axis of said safety plunger, said cross-section generally having the shape of an inverted T;

said recess having a first part and a second part, said first part being disposed nearer to said connection surface than said second part; and said first part being configured to receive said enlarged head upon said switching device being installed on a mounting structure and said second part being configured to receive said spring upon said switching device being installed on a mounting structure.

10. The switching device according to claim 8 wherein:

said device to bias comprises a spring, said spring being disposed immediately adjacent said enlarged head of said safety plunger and being disposed about said first end of said safety plunger;

said cam comprising an additional cam surface disposed adjacent said first depression, said additional cam surface having a first side and a second side disposed a substantial longitudinal distance from one another;

said additional cam surface comprising a first bevel disposed at said first side of said additional cam surface and a second bevel disposed at said second side of said additional cam surface;

said switching device being configured for being mounted on one of: a mounting plate; a mounting rail; and a plug-in pin base;

said latching mechanism further comprising a switch lock and a rocker arm both being associated with said latch;

said latch comprises a latching lever non-rotationally attached to said latch, said latching lever being in contact with said cam;

said cam surface and said additional cam surface being disposed substantially parallel to the longitudinal axis of said safety plunger;

said first and second depressions having a surface disposed substantially parallel to the longitudinal axis of said safety plunger; and said first and second bevels of said cam surface and said first and second bevels of said additional cam surface all being disposed at a substantial angle with respect to the longitudinal axis of said safety plunger.

11. The switching device according to claim 6 wherein said apparatus to move further comprises:

a mounting plate fixedly attached to said connection surface, said mounting plate having an opening disposed therein, said first end of said safety plunger being disposed in said opening;

said device to bias comprising a leaf spring, said leaf spring having a longitudinal axis, a first end and a second end disposed a substantial longitudinal distance from one another;

said first end of said leaf spring being fixedly attached to said mounting plate;

said second end of said leaf spring comprising a slot extending substantially parallel to the longitudinal axis of said leaf spring, said slot being disposed adjacent said opening of said mounting plate;

said leaf spring having a first side and a second side, said first side of said leaf spring facing said mounting plate and said second side of said leaf spring facing away from said first side of said leaf spring;

said enlarged head of said safety plunger being disposed at said second side of said leaf spring;

said safety plunger comprising an additional enlarged head disposed at said first side of said leaf spring, and a portion disposed between and connecting said enlarged head and said additional enlarged head; and said portion disposed between said enlarged head and said additional enlarged head being disposed in said slot.

12. The switching device according to claim 11 wherein:

said cam comprises a depression disposed adjacent said first side of said cam surface, said first bevel forming a transition between said cam surface and said depression;

said slot has one open end and one closed end, said closed end being disposed nearer to said first end of said leaf spring than said open end;

said mounting plate has a top portion, a bottom portion, a first edge, a second edge and a third edge, said first edge being substantially perpendicular to said second and third edges;

said first, second and third edges being disposed with respect to one another to form the general shape of a U;

said second and third edges being substantially parallel to one another;

said top portion and said bottom portion facing away from one another, said top portion facing said connection surface;

said leaf spring being disposed substantially parallel to said first edge and being disposed adjacent said first edge;

said first end of said leaf spring being fixedly attached to said bottom portion of said mounting plate;

said first edge comprising a plate extending from said first edge in a direction substantially perpendicular to said top and bottom portions of said mounting plate;

said plate being configured and disposed to prevent damage to said leaf spring;

said first end of said leaf spring being disposed adjacent said second edge of said mounting plate;

said apparatus to move further comprising a stopper disposed along said third edge of said mounting plate and being substantially parallel to said third edge of said mounting plate;

said stopper being disposed on said bottom portion of said mounting plate;

said stopper having a first terminal end and a second terminal end, said first terminal end being disposed adjacent said first end of said safety plunger;

said first terminal end of said stopper comprising a first leg and said second terminal end of said stopper comprising a second leg, each of said first and second legs having portions extending in a direction substantially perpendicular to said mounting plate;

said stopper comprising apparatus to permit sliding movement of said stopper along said bottom portion of said mounting plate;

said apparatus to permit comprising:

a longitudinal slot disposed adjacent said second terminal end of said stopper; and at least one pin disposed in said longitudinal slot and being fixedly fastened on said bottom portion of said mounting plate;

said first leg having a portion engageable with said second end of said leaf spring upon said stopper being moved in a direction away from said first edge of said mounting plate, said second leg thereby being in a position to block an attempt to mount said switching device on a mounting structure;

said first leg being alignable with said slot of said leaf spring upon movement of said stopper in a direction towards said first edge of said mounting plate;

said switching device being configured for being mounted on one of: a mounting plate; a mounting rail; and a plug-in pin base;

said latching mechanism further comprising a switch lock and a rocker arm both being associated with said latch;

said latch comprises a latching lever non-rotationally attached to said latch, said latching lever being in contact with said cam;

said cam surface being disposed substantially parallel to the longitudinal axis of said safety plunger;

said depression comprising a surface disposed substantially parallel to the longitudinal axis of said safety plunger; and said first and second bevels of said cam surface being disposed at a substantial angle with respect to the longitudinal axis of said safety plunger.

13. Mechanical switching device for being removably mounted on a mounting surface, such as a plug-in pin base, mounting plate or mounting rail, the mechanical switching device having: a housing, movable contacts, stationary contacts, the movable contacts and the stationary contacts both being disposed within the housing, the movable contacts and the stationary contacts both being removable from a mounting surface along with the housing upon the mechanical switching device being removed from a mounting structure, a connection surface, an actuator mechanism with a rocker arm, switch lock and latching mechanism for the movable contacts of the mechanical switching device, a safety plunger located in the mechanical switching device, the safety plunger being movable in opposition to a spring force, the safety plunger being linked by means of one terminal area with the latching mechanism of the switch lock, the safety plunger being extendable with its other terminal area out of the mechanical switching device, the safety plunger causing a tripping of the mechanical switching device when the mechanical switching device is removed from the mounting surface, the terminal area of the safety plunger linked with the latching mechanism having an operating cam with at least one oblong and bilaterally bevelled control cam which is bevelled on both sides.

14. Mechanical switching device according to claim 13, wherein the latching mechanism has a latch which is mounted so that it can rotate or move to establish the tripped position of the mechanical switching device, which latch is linked to the operating cam of the safety plunger, and whereby during the installation or removal of the mechanical switching device, as a result of the movement of the safety plunger, the operating cam of the safety plunger can move along the latch and a rotational movement or displacement of the latch can be produced which guarantees that the mechanical switching device is in the tripped position during the installation or removal process.

15. Mechanical switching device according to claim 14, wherein the tripped state can be produced when the linkage is established between the latching mechanism and at least one control cam of the safety plunger, and the untripped state of the mechanical switching device can be produced when the linkage is established between the latching mechanism and a latching depression formed by the remaining part of the operating cam and between the control cams.

16. Mechanical switching device according to claim 15, wherein upon the mechanical switching device being removed from a mounting surface, the extendable terminal area of the safety plunger is moved in response to the action of a spring into a position where it extends beyond the connection surface of the mechanical switching device.

17. Mechanical switching device according to claim 16, wherein upon the mechanical switching device being installed onto a mounting surface, the extendable terminal area of the safety plunger is in a position in which it is supported against the mounting surface and is retracted into the mechanical switching device against the spring force of the spring.

18. Mechanical switching device according to claim 17, wherein:

on the connection side of the mechanical switching device there is a recess which has at least one step for the location of the terminal area of the safety plunger and the compression spring when the mechanical switching device is in the installed position;

the longitudinal axis of the safety plunger is axially parallel to the direction of insertion and extraction respectively of the mechanical switching device, and to the direction of movement of the safety plunger; and the safety plunger is enlarged to form a head on its terminal area which can be extended beyond the connection surface of the mechanical switching device.

19. Mechanical switching device according to claim 18, wherein the safety plunger, in the area of its longitudinal extension, has a projecting stop which interacts with a corresponding abutment in the mechanical switching device to prevent the safety plunger from falling out of the mechanical switching device.

20. Mechanical switching device according to claim 13, wherein the terminal end of the safety plunger which is linked with the latching mechanism has an operating cam with a plurality of control cams, which are located one after another in the longitudinal direction of the safety plunger.

* * * * *